US005715572A

United States Patent [19]

Steinberg

[11] Patent Number: 5,715,572

[45] Date of Patent: Feb. 10, 1998

[54] HINGE

[75] Inventor: Amiram Steinberg, Moshay Avichail, Israel

[73] Assignee: Amiram Steinberg & Dalia Lapidot, Herzliya, Israel

[21] Appl. No.: 481,275

[22] PCT Filed: Jan. 4, 1994

[86] PCT No.: PCT/US94/00120

§ 371 Date: Dec. 6, 1995

§ 102(e) Date: Dec. 6, 1995

[87] PCT Pub. No.: WO94/16182

PCT Pub. Date: Jul. 21, 1994

[51] Int. Cl.[6] ..... E05D 11/10; E05D 11/08

[52] U.S. Cl. ..... 16/221; 114/274; 114/280

[58] Field of Search ..... 16/221, 255, 256, 16/319, 49, 51, 52, 54; 114/274, 279, 280, 281, 282

[56] References Cited

U.S. PATENT DOCUMENTS

| | | | |
|---|---|---|---|
| 1,281,774 | 6/1918 | Franckaerts . | |
| 2,603,179 | 7/1952 | Gardiner . | |
| 3,270,699 | 9/1966 | Bush | 114/66.5 |
| 3,417,722 | 12/1968 | O'Neill . | |
| 4,364,324 | 12/1982 | Warner . | |
| 4,711,195 | 12/1987 | Shutt . | |
| 4,715,304 | 12/1987 | Steinberg . | |
| 4,829,628 | 5/1989 | Vuksic . | |
| 4,955,312 | 9/1990 | Magazzu . | |
| 5,117,776 | 6/1992 | Thorpe . | |

FOREIGN PATENT DOCUMENTS

| | | |
|---|---|---|
| 889 225 | 2/1952 | United Kingdom . |
| 775 749 | 5/1957 | United Kingdom . |
| 869 978 | 6/1961 | United Kingdom . |
| 9304909 | 3/1993 | WIPO . |

*Primary Examiner*—Chuck Y. Mah
*Attorney, Agent, or Firm*—Ladas & Parry

[57] ABSTRACT

Hinge apparatus which includes first and second hinge members (12, 14) arranged for relative rotation about a hinge axis (18), and fluidic actuator apparatus (24). The fluidic actuator apparatus includes a force transfer member (22) having a first end attached to the first hinge member at an anchor location spaced from the hinge axis, and expandable pillow (25) apparatus associated with the force transfer member and operative to expand when exposed to a fluidic pressure thereby to apply a force along the force transfer member to the first hinge member so as to cause rotation of the first hinge member relative to the second hinge member in at least a first direction.

15 Claims, 38 Drawing Sheets

HINGE

The present invention relates to hinge mechanisms, watercraft and foil assemblies which include hinges, to hinged undulating propulsion elements, and to hinge controls therefor.

There exists a variety of watercraft including hydrofoils. A preferred embodiment of watercraft including a retractable hydrofoil is described in applicant's U.S. Pat. No. 4,715,304 and in the references cited therein. The hydrofoil has a main portion and a tip portion attached thereto.

In addition to providing retractable and adjustable hydrofoils, it would also be advantageous to be able to accurately and easily adjust the angular orientation of the hydrofoil tip portion relative to the main portion, thereby improving the instantaneous hydrodynamic characteristics of the hydrofoil and, therefore, of the watercraft.

The present invention seeks to provide a fluidic hinge assembly, such as a hydraulic, pneumatic or combined hydraulic-pneumatic hinge assembly, which may be incorporated into mechanical control systems such as used with hydrofoils, airfoils, robot systems, artificial limbs, lifting devices such as cranes, and fish-tail propulsion devices.

There is provided, therefore, in accordance with a preferred embodiment of the invention, hinge apparatus which includes first and second hinge members arranged for relative rotation about a hinge axis, and fluidic actuator apparatus. The fluidic actuator apparatus includes a force transfer member having a first end attached to the first hinge member at an anchor location spaced from the hinge axis, and expandable pillow apparatus associated with the force transfer member and operative to expand when exposed to a fluidic pressure thereby to apply a force along the force transfer member to the first hinge member so as to cause rotation of the first hinge member relative to the second hinge member in at least a first direction.

Additionally in accordance with a preferred embodiment of the invention, the hinge apparatus also includes valve apparatus for selectably coupling the expandable pillow apparatus to a fluidic pressure source.

Further in accordance with a preferred embodiment of the invention, the pillow apparatus has a flexible, expandable contact surface and the force transfer member has a second end attached to the second hinge member such that the force transfer member is positioned against the contact surface, and wherein pressurization of the pillow apparatus causes a lateral displacement of the force transfer member by the contact surface, thereby to cause a force to be applied along the force transfer member to the first hinge member.

Additionally in accordance with a preferred embodiment of the invention, the force transfer member is a first force transfer member and the hinge apparatus also includes a second force transfer member which has a first end attached to the first hinge member at an anchor location spaced from the hinge axis, and wherein the pillow apparatus has an additional flexible, expandable contact surface and the second force transfer member has a second end attached to the second hinge member such that the force transfer member is positioned against the additional contact surface, and wherein pressurization of the pillow apparatus causes a lateral displacement of the second force transfer member by the additional contact surface, thereby to cause a force to be applied along the force transfer member to the first hinge member.

Further in accordance with a preferred embodiment of the invention, the valve apparatus is operative to permit expansion of a single predetermined one of the contact surfaces in accordance with a selected operational mode of the actuator apparatus.

Additionally in accordance with a preferred embodiment of the invention, the pillow apparatus includes a pair of fluid filled pillow members each having one of the contact surfaces.

In accordance with an alternative embodiment of the invention, the hinge apparatus forms part of a foil assembly of which one preferred use is as a hydrofoil.

In accordance with a further embodiment of the invention, there is provided hinge apparatus which includes first and second hinge members arranged for relative rotation about a hinge axis; a resilient pivot member arranged along the hinge axis and between the first and second hinge members and adapted to elastically deform in response to application to the pivot member of a rotational force via the first hinge member, thereby to permit relative rotation of the first and second hinge members; and actuator apparatus arranged to selectably apply a rotational force to the first hinge member thereby to cause a relative rotation of the first and second hinge members.

In accordance with yet a further alternative embodiment of the invention, there is provided undulating hinged propulsion apparatus for use with a watercraft. The propulsion apparatus includes a hinge assembly adapted for mounting in association with a watercraft and further adapted for undulating motion in contact with water thereby to cause propulsion of the watercraft in the water, and fluidic actuator apparatus.

The hinge assembly includes a first hinge member adapted for mounting in association with the body of a watercraft; a second hinge member arranged for rotation relative to the first hinge member about a first hinge axis located between the first hinge member and the second hinge member; and a third hinge member arranged for rotation relative to the second hinge member about a second hinge axis located between the second hinge member and the third hinge member.

The fluidic actuator apparatus includes first force transfer apparatus having a first end attached to the second hinge member at an anchor location spaced from the first hinge axis and having a second end associated with the first hinge member; second force transfer apparatus having a first end attached to the third hinge member at an anchor location spaced from the second hinge axis and having a second end associated with the second hinge member; expandable pillow apparatus associated with the first and second force transfer apparatus and operative to expand when exposed to a fluidic pressure thereby to apply a force along at least one of the first and second force transfer apparatus to the corresponding one of the second and third hinge members so as to cause a selected rotation of at least one of the second and third hinge members about the first and second hinge axes, respectively, thereby to cause an undulating motion of the hinge assembly.

The present invention will be understood and appreciated more fully from the following detailed description, taken in conjunction with the drawings in which.

Figure 1A:
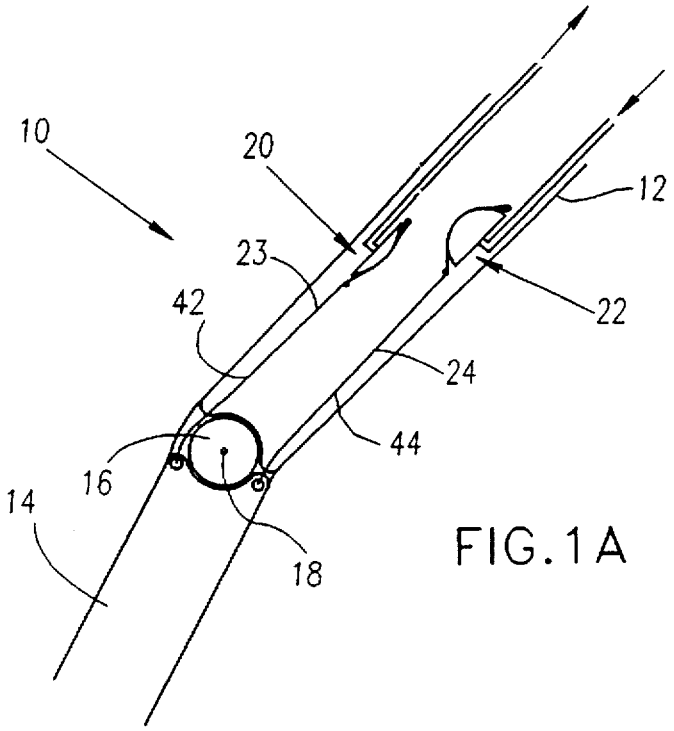
FIGS. 1A and 1B are pictorial views of a fluidic hinge assembly constructed and operative in accordance with the present invention, illustrated in respective first and second operative orientations.
Figure 1B:
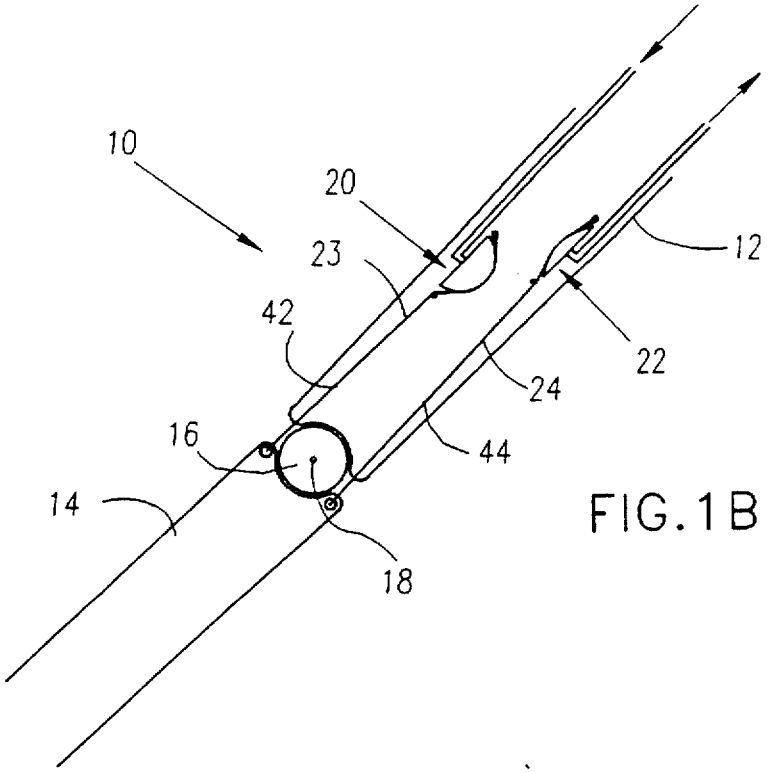

Reference is made to FIGS. 1A and 1B, in which is shown a fluidic hinge assembly, referenced generally 10, constructed and operative in accordance with a preferred embodiment of the invention. Hinge assembly 10 includes first and second hinge members, respectively referenced 12 and 14, which are spaced apart by a pivot member 16 which defines a hinge axis 18. In FIG. 1A, hinge assembly 10 is shown in a partially folded orientation, while in FIG. 1B, hinge assembly 10 is in a generally straightened orientation.

Mounted in second hinge member 12 are first and second fluidic actuator assemblies denoted by 20 and 22, respectively. Assemblies 20 and 22 have associated therewith flexible force transfer members, respectively referenced 23 and 24. Selectable tensioning of force transfer members 23 and 24 via actuator assemblies 20 and 22 causes a rotation of first hinge member 12 about hinge axis 18.

According to the present invention, the force transfer members 23 and 24 may be any suitable members, including flexible rods, push-pull elements such as the Push Pull by Teleflex Co., cables, chains, belts and bands. Preferably, the force transfer members are formed of Kevlar, having approximately 2% elongation vs. steel having only approximately 0.5% elongation. This contributes to the shock absorbing chain.

Figure 2:
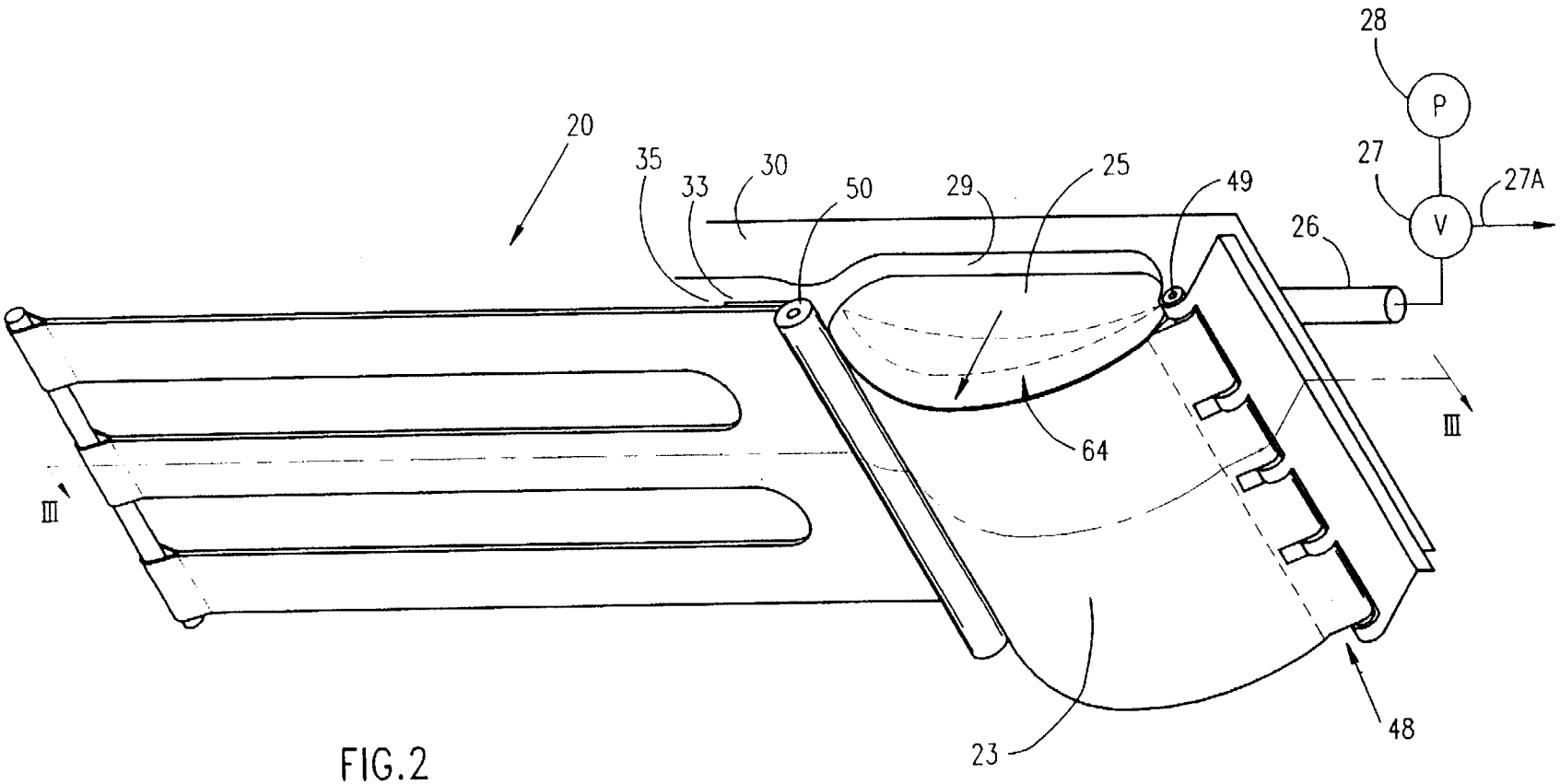
FIG. 2 is a pictorial view of a hinge actuator assembly constructed and operative in accordance with a preferred embodiment of the present invention.
Figure 3A:
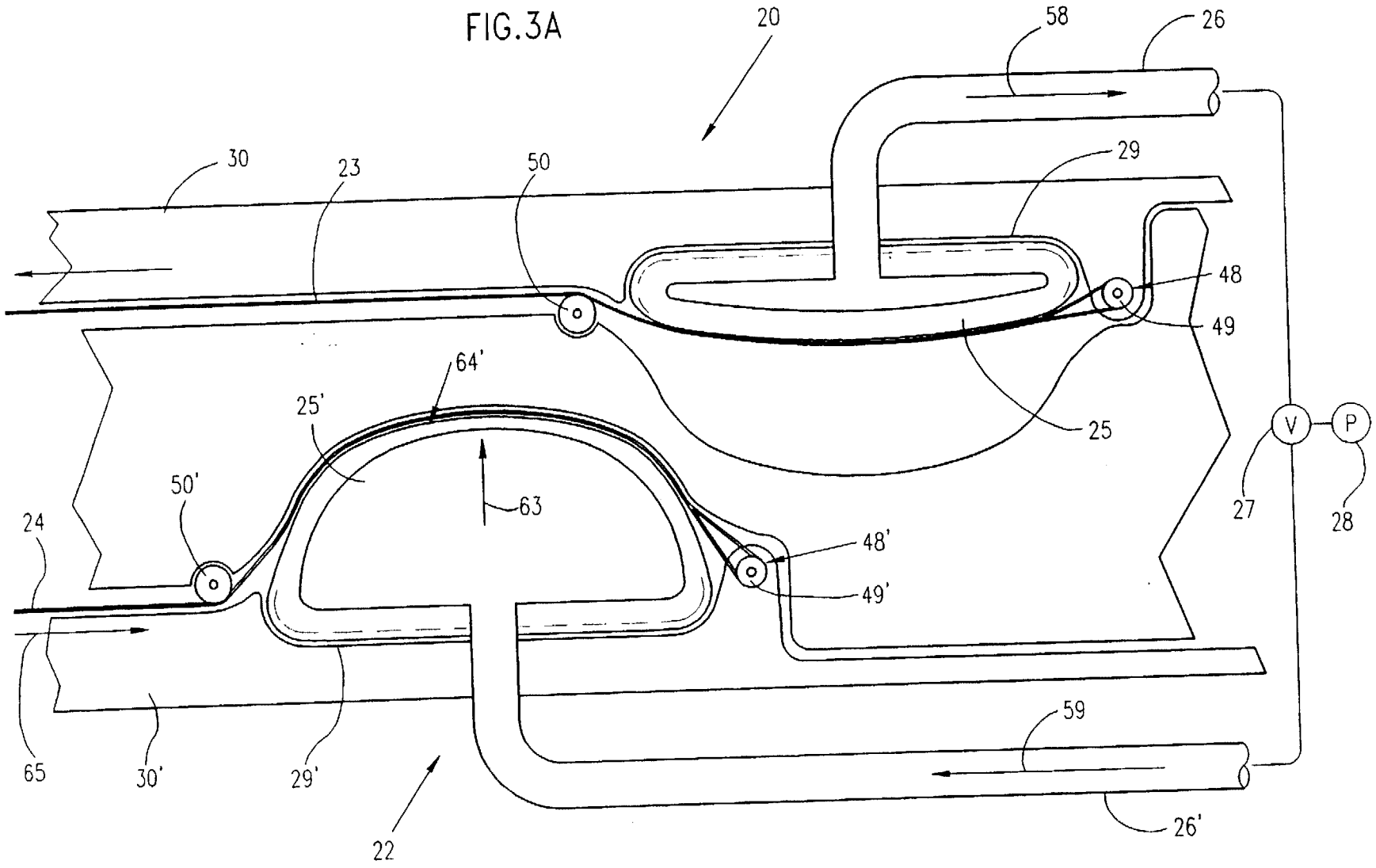
FIGS. 3A and 3B are schematic cross-sectional side view illustrations of a pair of hinge actuator assemblies in respective first and second operative modes corresponding to the first and second orientations of the hinge assembly illustrated in FIGS. 1A and 1B and 2.
Figure 3B:
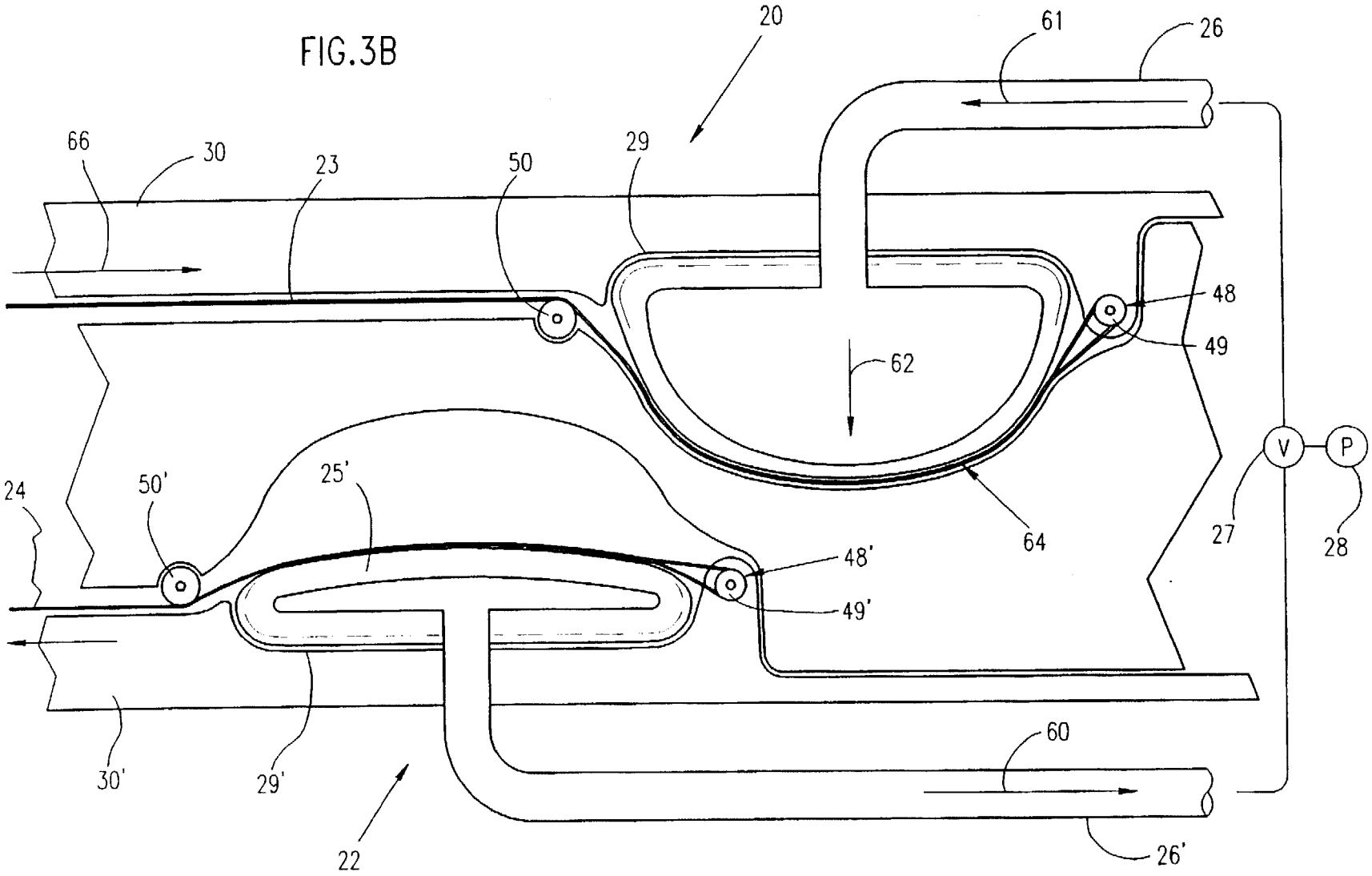

Reference is now made to FIGS. 2, 3A and 3B, in which actuator assemblies 20 and 22 are illustrated. The structure and operation of assemblies 20 and 22 are similar. Accordingly, for purposes of conciseness, only first actuator assembly 20 is described in detail herein, and components of second assembly 22 described in conjunction with first assembly 20 bear reference numbers similar to their corresponding components in first assembly 20, but with the addition of a prime (') notation.

Assembly 20 has an expandable pillow 25 made preferably of a resilient, rubberized, reinforced, gas impermeable material. Pillow 25 becomes inflated when pressurized and becomes deflated when de-pressurized. The inflated and deflated positions of pillow 25 are illustrated in FIG. 2 in full and broken lines, respectively. It is appreciated that side walls are provided, similar to side walls 652 in the embodiment of FIGS. 32A–32C, however, these are not shown in FIG. 2.

Pressurization of the pillow is provided via a fluid supply conduit 26 by operation of a valve assembly 27 in conjunction with a suitable fluidic pressure source 28. De-pressurization of the pillow may be provided by venting of the fluid therein, as indicated by an arrow 27*a* (FIG. 2), via fluid supply conduit 26 and valve assembly 27.

According to one embodiment of the invention, fluidic pressure source 28 is a hydraulic pressure source. According to alternative embodiments of the invention, however, the fluidic pressure source may comprise a pneumatic pressure source or a combination hydraulic/pneumatic pressure source.

Pillow 25 is seated in a recess 29 of a base 30, which is preferably a rearward extension of hinge member 14 (FIGS. 1A and 1B).

Preferably, TEFLON sliding bearing surfaces 33 and 35 are provided which facilitate the motion of flexible force transfer member 23 relative to the pillow 25.

Figure 4A:
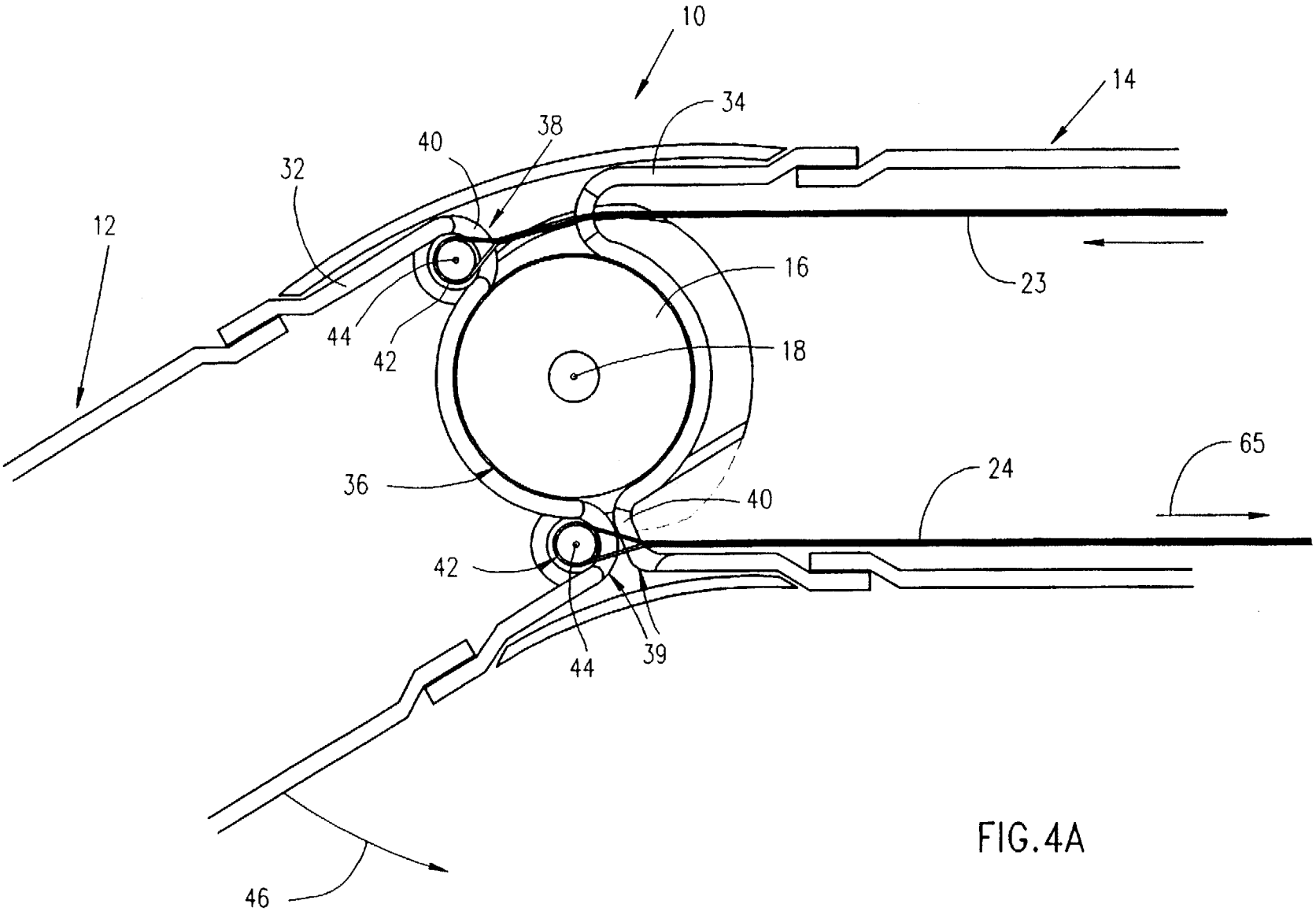
FIGS. 4A and 4B are schematic side-view illustrations of a joint portion of the hinge assembly illustrated in FIGS. 1A and 1B, in respective first and second operative orientations corresponding to the first and second orientations illustrated in FIGS. 3A and 3B.
Figure 4B:
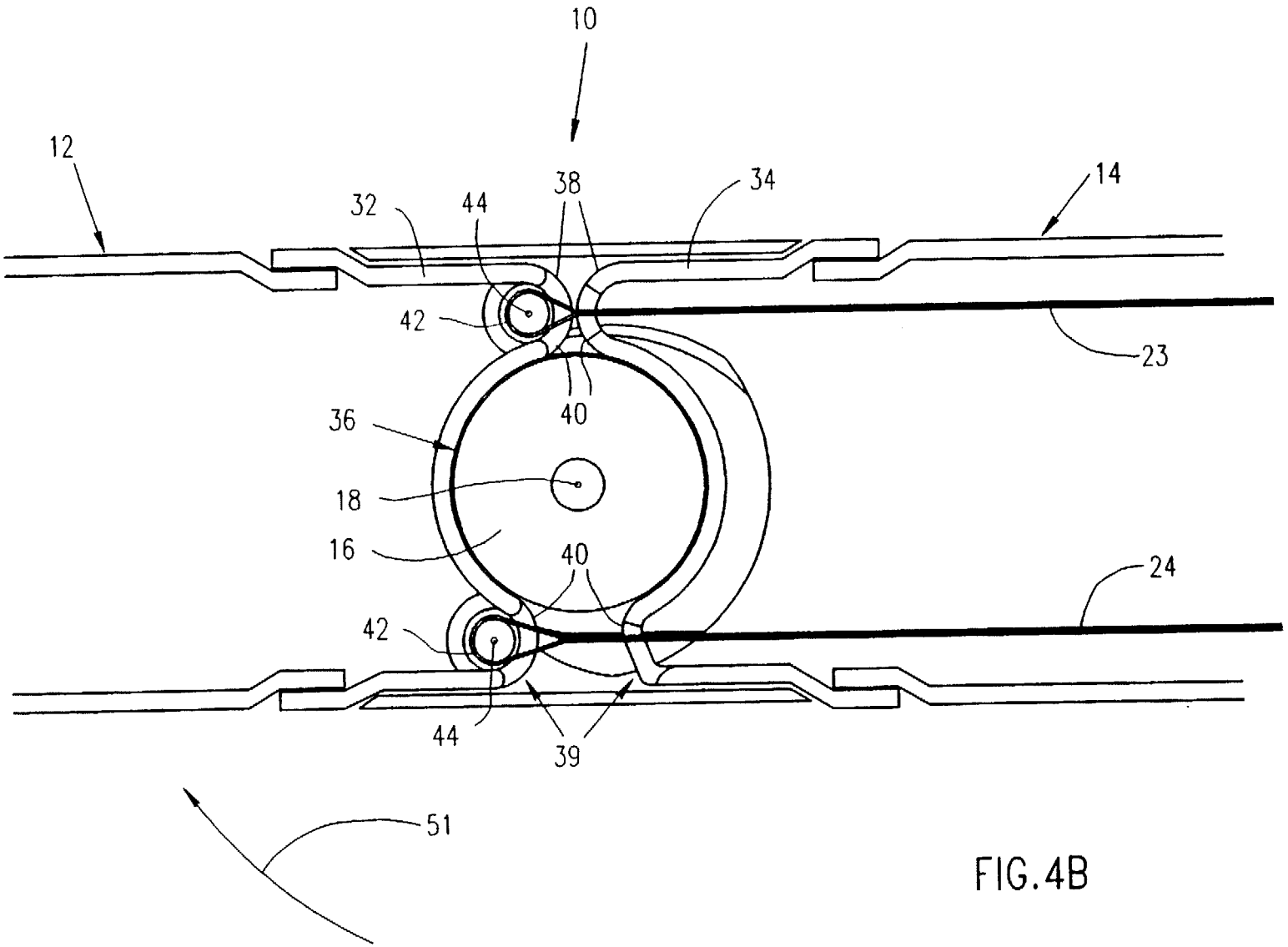
Figure 4C:
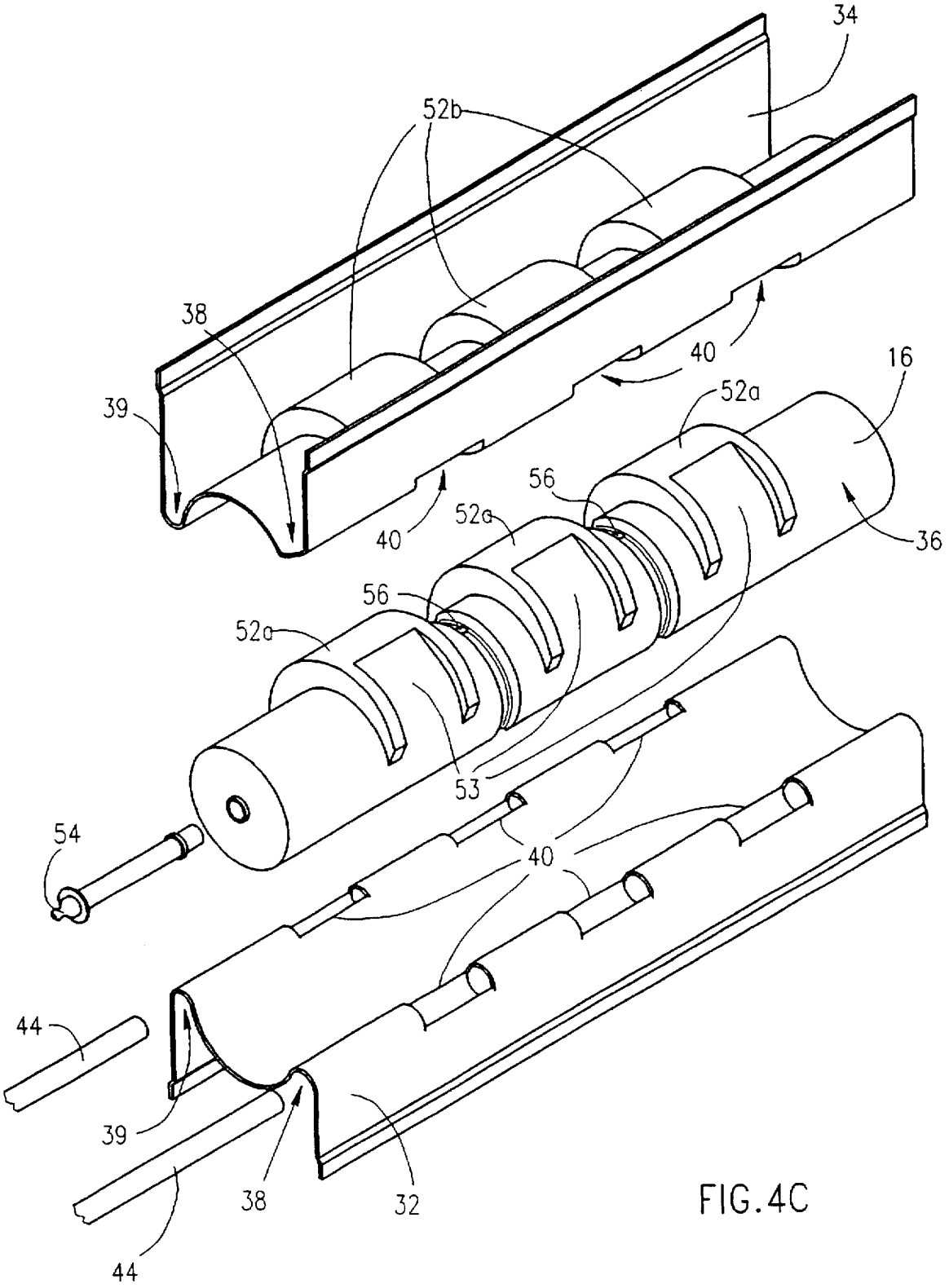
FIG. 4C is an exploded pictorial view of part of the joint portion of the hinge assembly illustrated in FIGS. 4A and 4B.

Referring now to FIGS. 4A–4C, it is seen that hinge members 12 and 14 have respective, generally semicircular, first and second seating members 32 and 34 which are arranged to engage a cylindrical outer surface 36 of the pivot member 16. The contact between the respective surfaces of the seating members 32 and 34 and the pivot member 16 is a low friction contact so as to enable relative rotation of the hinge members and 14 about hinge axis 18.

Typically, the low friction contact is facilitated by the provision of a lubricant, such as grease, to the interface between the seating members 32 and 34 and the pivot 16. Alternatively, a low friction contact between seating members 32 and 34 and pivot member 16 may be provided by forming pivot member 16 from a suitable polymeric material such as TEFLON (R) (polytetrafluoroethene) or by coating the pivot member 16 therewith.

Each of seating members 32 and 34 defines a pair of generally rearward-facing channel portions 38 and 39 in which are provided a plurality of openings 40. Referring now particularly to FIGS. 4A and 4B, first and second flexible force transfer members 23 and 24 (also shown in FIGS. 1A–3B) are seen to extend through openings 40 and are anchored, at first ends 42, to respective rod members 44 located in generally rearward facing channel portions 38 of first seating member 32.

Referring now also to FIGS. 2–3B, it is seen that second ends 48 of force transfer members 23 and 24 are anchored to base 30 via a rigid roller support 49. A freely rotatable roller 50 is mounted across force transfer member 23 parallel to roller support 49 in order to support force transfer member 23 along a predetermined path.

Force transfer members 23 and 24 are arranged to apply a pulling force to first hinge member 12 and pivot member 16 in the direction of second hinge member 14, thereby to maintain contact therebetween. It will thus be appreciated that adjustment of the pulling force in force transfer members 23 and 24 by respective first and second actuator assemblies 20 and 22 causes a relative rotation of the hinge members about the hinge axis. This is described hereinbelow in more detail, in conjunction with FIGS. 3A–4B.

The relative rotation between hinge members 12 and 14 is limited to a predetermined rotational sector by the spacing between opposing channel portions 38 and 39 of the respective hinge members. Accordingly, in the present example, a first extreme operative orientation of the hinge assembly is illustrated in FIG. 4A, wherein rotation of hinge member 12 has been provided in the direction indicated by an arrow 46. In the position illustrated, further rotation in this direction is prevented by the abutting of adjacent channel portions 39 of the respective hinge members 12 and 14.

A second extreme operative orientation of the hinge assembly is illustrated in FIG. 4B. In this position, the hinge assembly 10 has been straightened by rotating hinge member 12 in the direction indicated by an arrow 51. In the position illustrated, further rotation in this direction is prevented by the abutting of adjacent channel portions 38 of the respective hinge members 12 and 14.

With particular reference to FIG. 4C, according to one embodiment of the invention, pivot member 16 defines a plurality of sheaf-like surface protrusions 52*a* which are configured for engagement with similarly configured depressions 52*b* formed in second seating member 34. This provides locking of the pivot member 16 with the second seating member and, therefore, with second hinge member 14, such that during relative rotation of first hinge member 12 with respect to second hinge member 14, pivot member 16 remains fixed with respect to second hinge member 14. Sheaf-like 30 protrusions 52*a* define, together with surface 36 of pivot member 16, grooves 53 which define a path for force transfer member 23.

A lubrication nipple 54 is connected with openings 56 in pivot member 16 via a hollow interior space therein (not shown), thereby to facilitate periodic replenishment of a lubrication fluid to the interface between seating members 32 and 34 and pivot member 16.

The operation of actuator assemblies 20 and 22 is now described.

Referring now particularly to FIGS. 3A, 4A and 4B, it is seen that when it is sought to rotate hinge assembly 10 from the position shown in FIG. 4B to the position shown in FIG. 4A, valve assembly 27 is operated so as to de-pressurize pillow 25 of first assembly 20 and to pressurize pillow 25' of second assembly 22. The respective de-pressurization and pressurization are indicated by arrows 58 and 59 (FIG. 3A).

According to an embodiment of the invention, valve assembly 27 may be arranged so as to cause a closed circuit transfer of fluid from the pillow to be de-pressurized directly to the pillow to be pressurized.

Deflation of pillow 25 causes a slackening in force transfer member 23. At the same time, the inflation of pillow 25' of second assembly 22 causes a lateral expansion of the pillow, in a direction indicated generally by an arrow 63, against the second force transfer member 24. As force transfer member 24 is prevented by roller 50' from moving laterally, the force applied to the force transfer member is translated into a generally axial pulling force in the general direction of support 49'. The pulling force increases as a contact surface 64' of pillow 25' continues to push laterally outward against force transfer member 24. The direction of the pulling force applied to second force transfer member 24 is indicated by an arrow 65 (FIGS. 3A and 4A).

As the position of pivot member 16 relative to base 30' is fixed, the pulling force applied to the hinge member 12 via the force transfer member 24 and via rod 42 causes a sliding rotation of the hinge member 12 about the pivot member 16 in the direction indicated by arrow 46 (FIG. 4A). Rotation of the hinge member 12 about the pivot member 16 continues until the hinge assembly becomes folded such that adjacent channel portions 39 of hinge members 12 and 14 touch (FIG. 4A) and force transfer member 23 is subjected to a maximum extension, thereby preventing further relative rotation of the hinge assembly in the direction described.

In order to straighten hinge assembly 10, the above-described respective inflation and deflation of pillows 25' and 25 is reversed. Accordingly, pillow 25' of second assembly 22 is de-pressurized, as indicated by an arrow 60 (FIG. 3B) via conduit 26', and pillow 25 of first assembly 20 is pressurized, as indicated by an arrow 61 (FIG. 3B), and thus inflated by supplying a fluid via conduit 26.

Deflation of pillow 25' causes a slackening in second force transfer member 24. At the same time, the inflation of pillow 25 of first assembly 20 causes a lateral expansion of the pillow, in a direction indicated generally by an arrow 62, against the first force transfer member 23. As described above in conjunction with FIG. 3A, the lateral force applied to the force transfer member is translated into an axial pulling force. The pulling force increases as contact surface 64 of pillow 25 continues to push laterally outward against force transfer member 23. The direction of the pulling force applied to first force transfer member 23 is indicated by an arrow 66.

As the position of pivot member 16 (FIGS. 4A and 4B) relative to base 30 is fixed, the pulling force applied to the hinge member 12 via the force transfer member and via rod 42 causes a sliding rotation of the hinge member 12 about the pivot member 16 in the direction indicated by arrow 51 (FIG. 4B). Once the hinge assembly has been straightened, as illustrated in FIG. 4B, adjacent channel portions 38 of the hinge members 12 and 14 touch (FIG. 4B) and force transfer member 24 is subjected to a maximum extension, thereby preventing further relative rotation of the hinge assembly in the direction described.

Hinge assembly 10 is shown and described above in conjunction with FIGS. 1A, 1B, 4A and 4B as a knee-type joint wherein in one extreme position (FIG. 4B) hinge members 12 and 14 are substantially coaxial so as to define an angle of 180°. It will be appreciated, however, that this is for exemplary purposes only, and, in accordance with an alternative embodiment of the invention, hinge assembly 10 may be adapted for relative rotation between two non-coaxial positions.

Figure 5A:
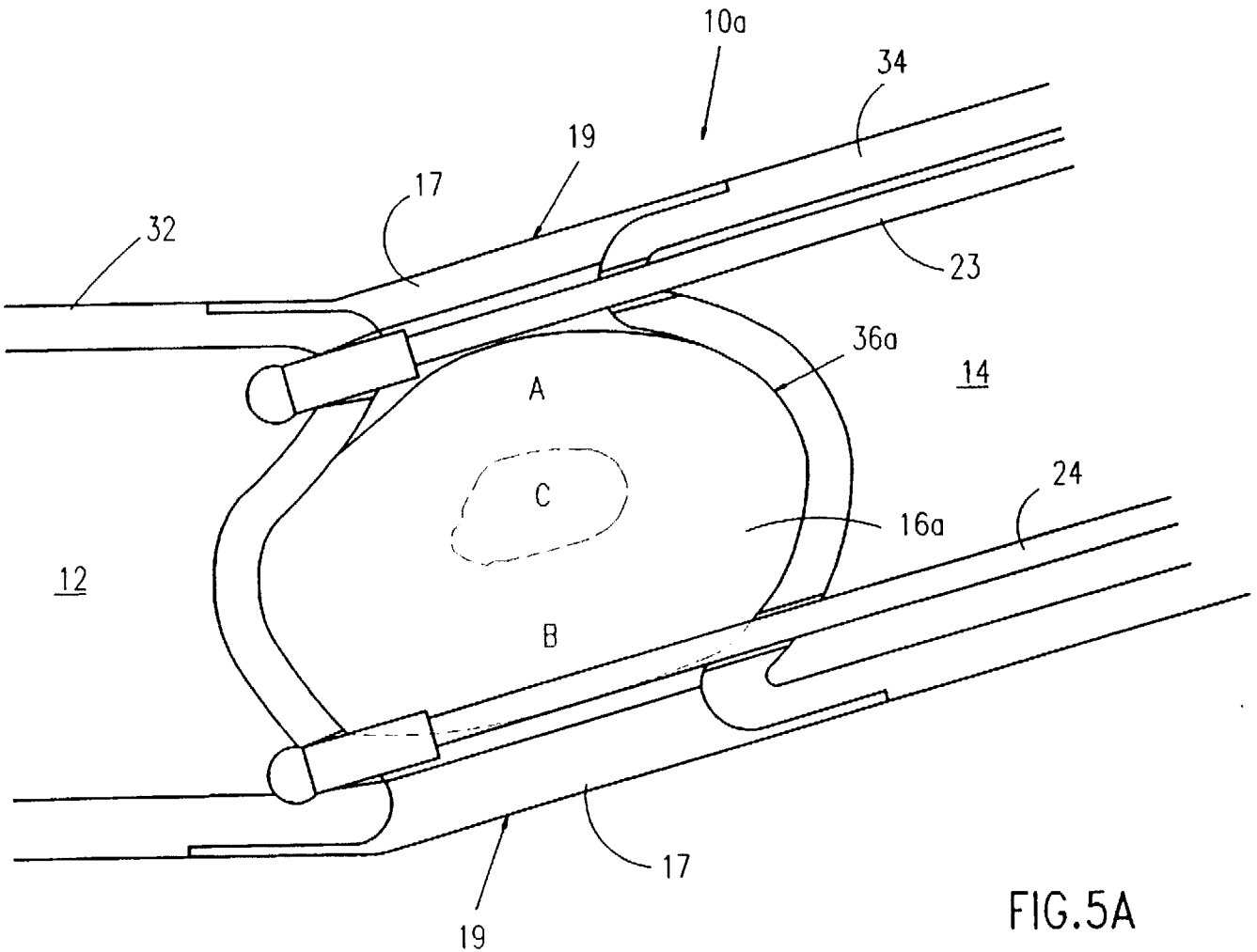
FIGS. 5A and 5B are schematic side-view illustrations of a joint portion of a hinge assembly similar to that illustrated in FIGS. 1A and 2B but employing a non-cylindrical, resilient pivot member, in respective first and second operative orientations, in accordance with an alternative embodiment of the invention.
Figure 5B:
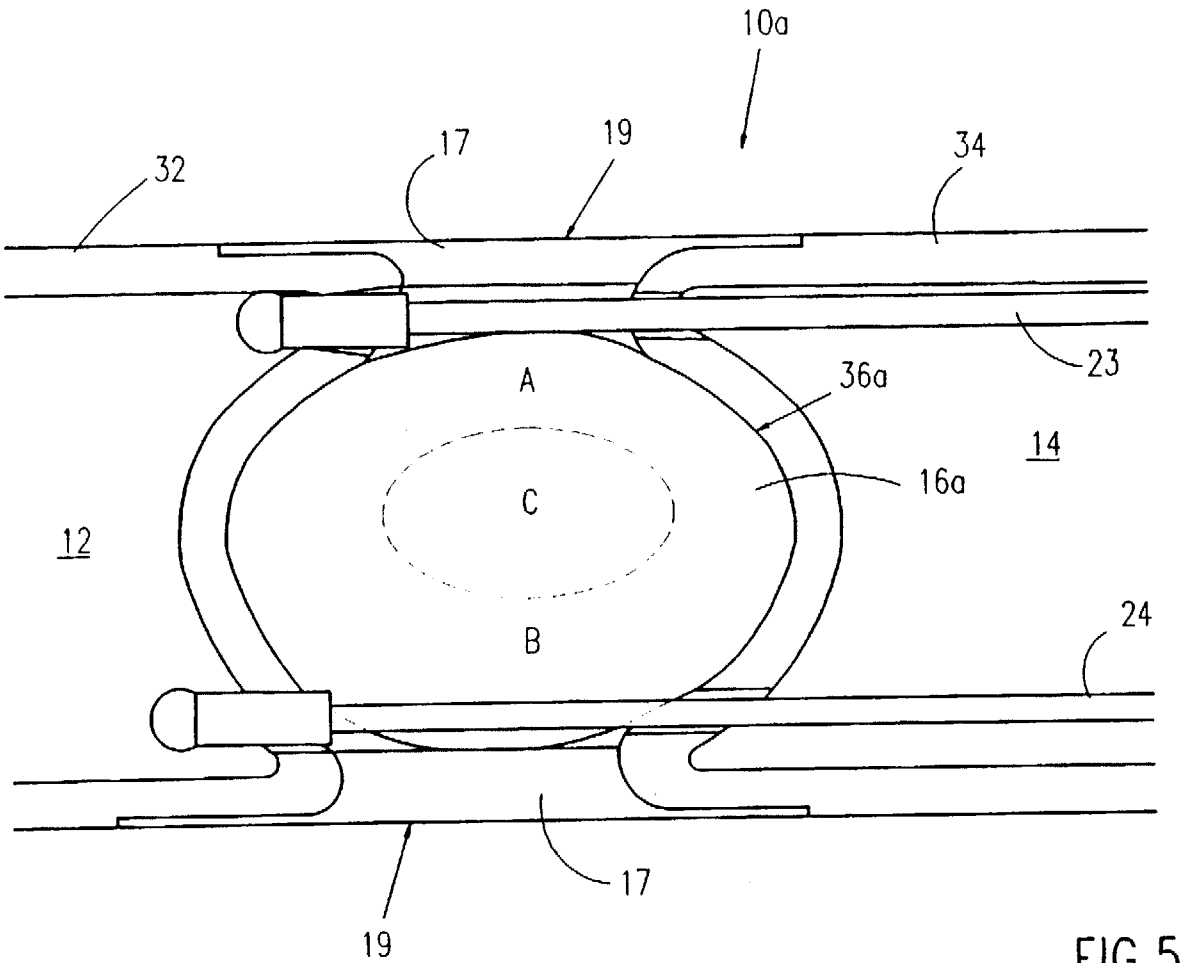

Reference is now made to FIGS. 5A and 5B, in which a joint portion of a hinge assembly, referenced generally **10*a*, is illustrated in respective partially folded and straight (unfolded) operative orientations. In accordance with the present embodiment of the invention, pivot member 16, shown and described above in conjunction with FIGS. 4A–4C, is replaced by a non-cylindrical, flexible, resilient pivot member 16*a*. Pivot member 16*a*** may be made of any suitable resilient material, of which an example is an elastomer having a shore A-hardness (DIN 53505) of 80, such as Fibroflex (R) type no. 5 sold by Fibro of Germany.

Pivot member **16*a* defines an exterior surface 36*a* which is disposed between and engages seating members 32 and 34. Accordingly, when a force is applied along either of force transfer members 23 or 24, relative rotation of first and second hinge members 12 and 14 is permitted by elastic deformation of flexible member 16*a***. This may be seen by a comparison of FIG. 5A with FIG. 5B.

In FIG. 5A, the hinge assembly is seen to be in a partially folded orientation, wherein first force transfer member 23 applies a force to first hinge member 12, so as to compress an upper portion A of member **16*a*. A reduction in the force along first force transfer member 23 and application of a force to first hinge member 12 via second force transfer member 24 permits an elastic return of upper portion A of member 16*a* to a non-compressed state, and causes compression of a lower portion B of member 16*a***, as seen in FIG. 5B.

Although flexible member **16*a* is illustrated as being made of a solid piece of material, it may alternatively be provided with a hollow space C as indicated by the broken line. Provision of the hollow space allows substantially any desired degree of flexibility of pivot member 16*a* to be realized. The presence of an unfilled hollow space C may impart greater flexibility to the pivot member 16*a***. However, the hollow space C may be filled with a rigid material such as metal or plastic, so as to decrease flexibility.

Although the pivot member **16*a*** illustrated in FIGS. 5A and 5B is generally elliptical in cross-section, this is for exemplary purposes only and it may be provided with any suitable cross-sectional configuration.

Further according to the present embodiment, there may also be provided flexible cover members, referenced 17. Cover members 17 define surfaces 19 which, when members 17 are properly seated between seating members 32 and 34, define a low drag extension of members 32 and 34. This is particularly important in aero- and hydrodynamic applications. Cover members 17 also prevent dirt from entering the interfaces between the pivot member and the hinge members.

Figure 5C:
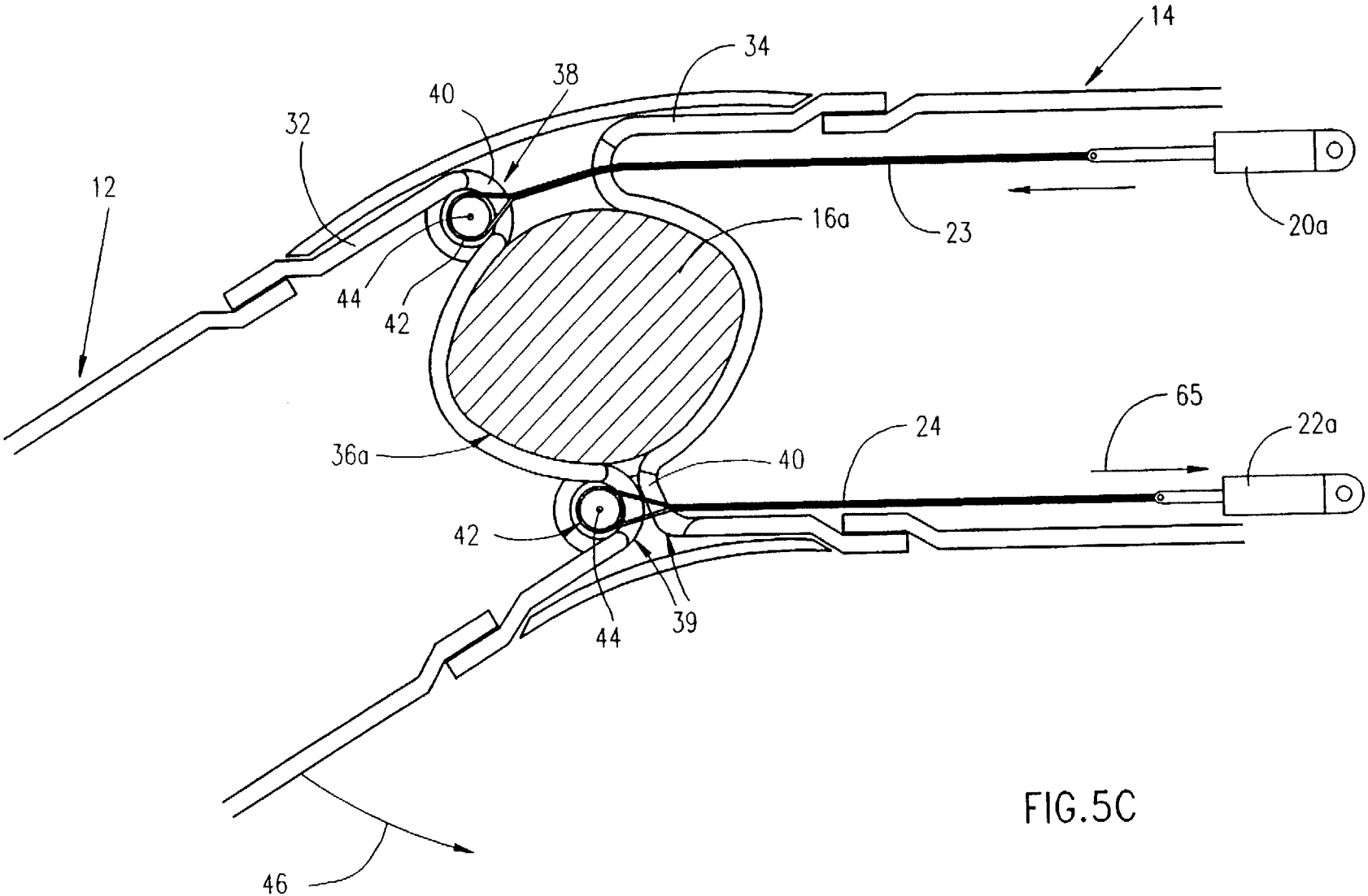
FIG. 5C is a schematic illustration of a joint portion of a hinge assembly in a partially folded orientation, substantially as illustrated in FIG. 4A, but employing a non-cylindrical resilient pivot member as shown in FIGS. 5A and 5B in conjunction with piston assemblies.

Reference is now made to FIG. 5C, in which is illustrated a joint portion of a hinge assembly in a partially folded orientation, substantially as illustrated in FIG. 4A, but employing the non-cylindrical, resilient, flexible pivot member **16*a* of FIGS. 5A and 5B, and further employing any type of suitable actuator for applying rotational forces via force transfer members 23 and 24. In the present example, the actuators, referenced 20*a* and 22*a***, are piston and cylinder assemblies, although they may be replaced by any suitable mechanical or fluidic actuators.

Figure 5D:
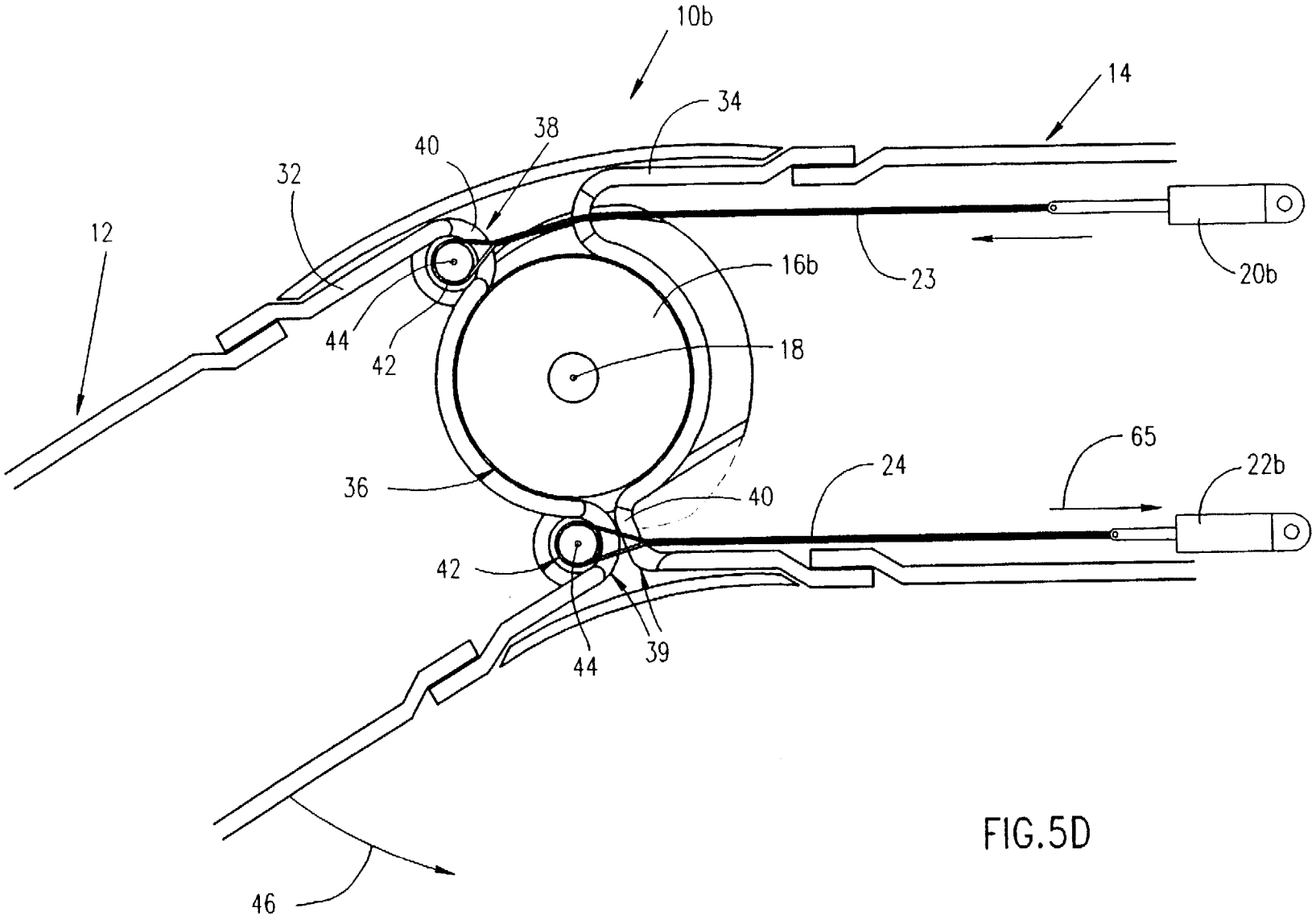
FIG. 5D is a schematic illustration of a joint portion of a hinge assembly in a partially folded orientation, substantially as illustrated in FIG. 5C, but employing a cylindrical resilient pivot member.

Reference is now made to FIG. 5D, in which is illustrated a joint portion of a hinge assembly **10*b* in a partially folded orientation, substantially as illustrated in FIG. 5C, but employing a flexible, resilient pivot member, referenced 16*b*, that has a cylindrical configuration. Pivot member 16*b* may be made of a material similar to that of resilient pivot member 16*a***, described in conjunction with FIGS. 5A and 5B above, or may be formed of a rigid material.

The hinge assembly may employ any type of suitable actuator for applying rotational forces via force transfer members 23 and 24. In the present example, the actuators, referenced **20*b* and 22*b***, are piston and cylinder assemblies, although they may be replaced by any suitable mechanical or fluidic actuators.

It will be appreciated by persons skilled in the art that the provision of a flexible, resilient pivot member enables the hinge assembly to withstand impact forces to a greater degree than may be possible with a pivot member made of a non-resilient material.

Reference is now made to FIGS. 6A–9 in which are shown actuator assemblies similar to those shown and described hereinabove in conjunction with FIGS. 2–3B, but which include bumper apparatus for absorbing sudden impact forces applied to the hinge assembly. For the purpose of conciseness, all components shown and described above in conjunction with FIGS. 2–3B are denoted in FIGS. 6A–9 by similar reference numerals and are not described again except as may be necessary for understanding of the present embodiments.

Figure 6A:
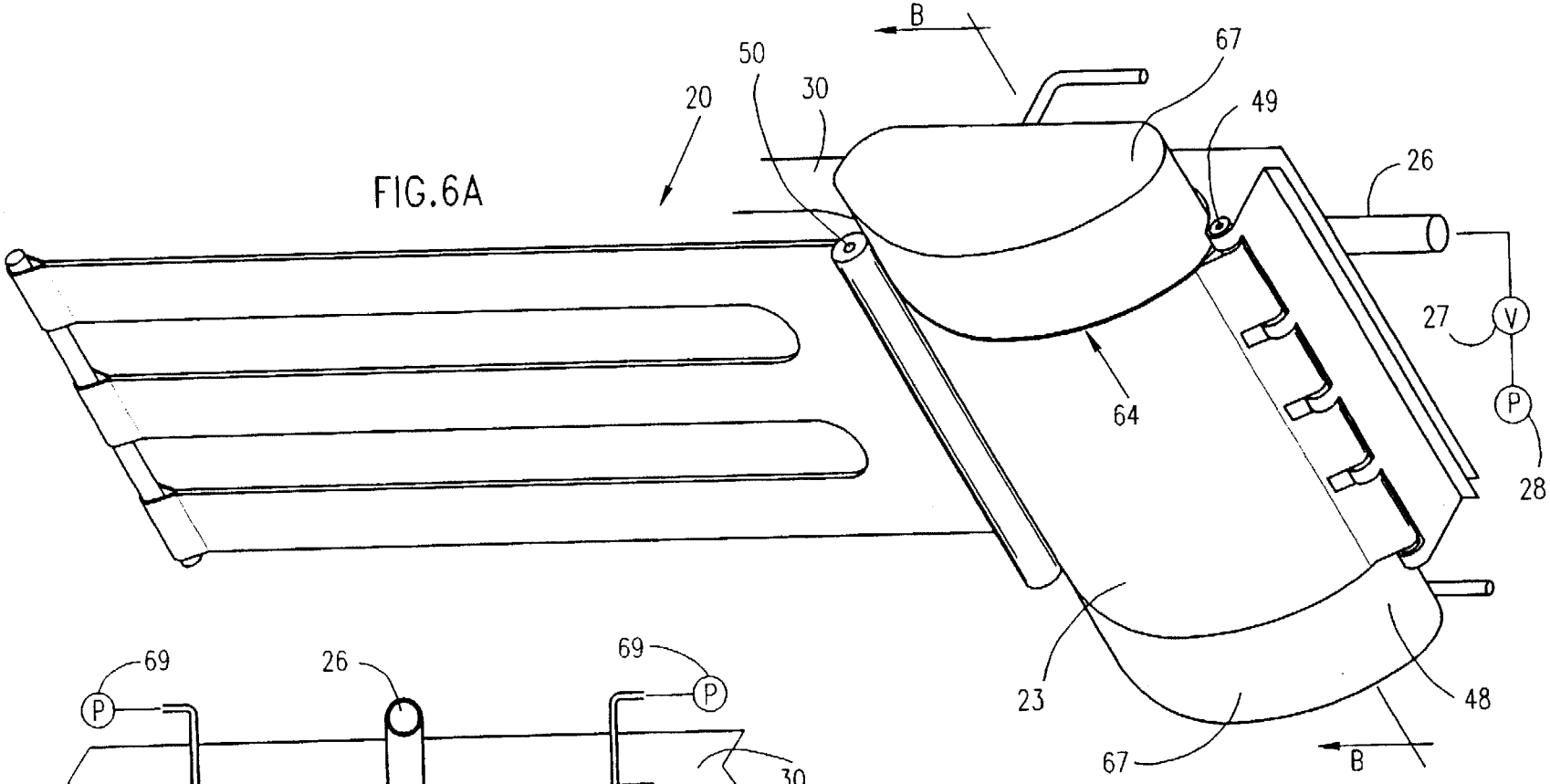
FIGS. 6A and 6B are respective pictorial and sectional illustrations of a hinge actuator assembly including bumper apparatus in accordance with an embodiment of the invention.
Figure 6B:
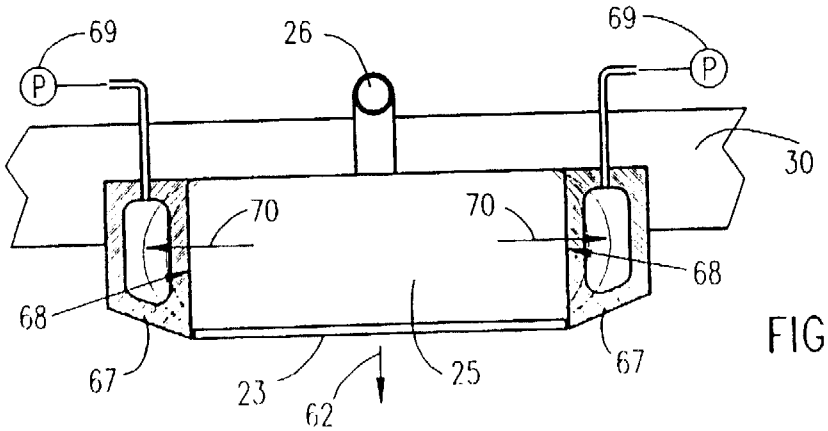

In the embodiment illustrated in FIGS. 6A and 6B, a pair of fluidic bumpers 67 is mounted in base 30 in abutting contact with side portions 68 of pillow 25. According to the present embodiment bumpers 67 are fluid filled cushions. The internal fluid pressure of the bumpers is maintained by respective fluid pumps 69 as shown. Alternatively, pumps 69 may be replaced by a single fluid pump.

As described above in conjunction with FIGS. 3A and 3B, pressurization of the pillow 25 causes expansion thereof in the direction of arrow 62. Accordingly, bumpers 67 are maintained at a sufficiently high pressure so as to withstand any lateral forces applied thereto by pillow 25 during normal use. However, in order to protect the hinge assembly, bumpers 67 are adapted to permit a lateral expansion of pillow 25, as indicated by arrows 70, in response to a momentary impact force which may be applied to the hinge assembly, and, consequently, also to the force transfer member 23 and pillow 25.

Figures 7A, 7B:
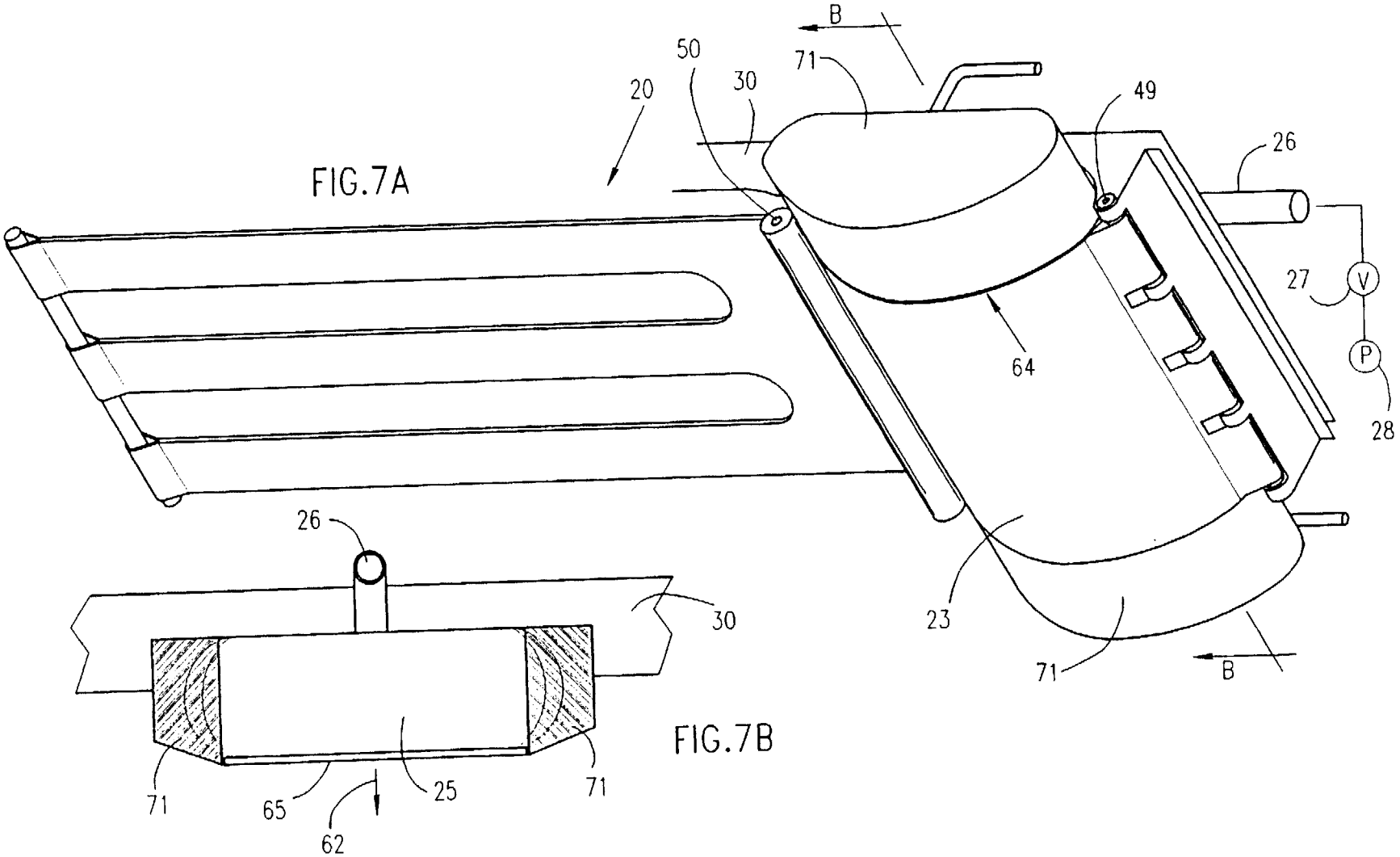
FIGS. 7A and 7B are respective pictorial and sectional illustrations of a hinge actuator assembly including bumper apparatus in accordance with an alternative embodiment of the invention.

Referring now briefly to FIGS. 7A and 7B, there is illustrated a fluidic actuator assembly 20, similar to that illustrated in FIGS. 6A and 6B, except that, in the present embodiment, a pair of solid bumpers 71 is provided in place of the fluid filled bumpers 67 (FIGS. 6A and 6B). Bumpers 71 may be formed of rubber or of any either similarly resilient material.

Figure 8:
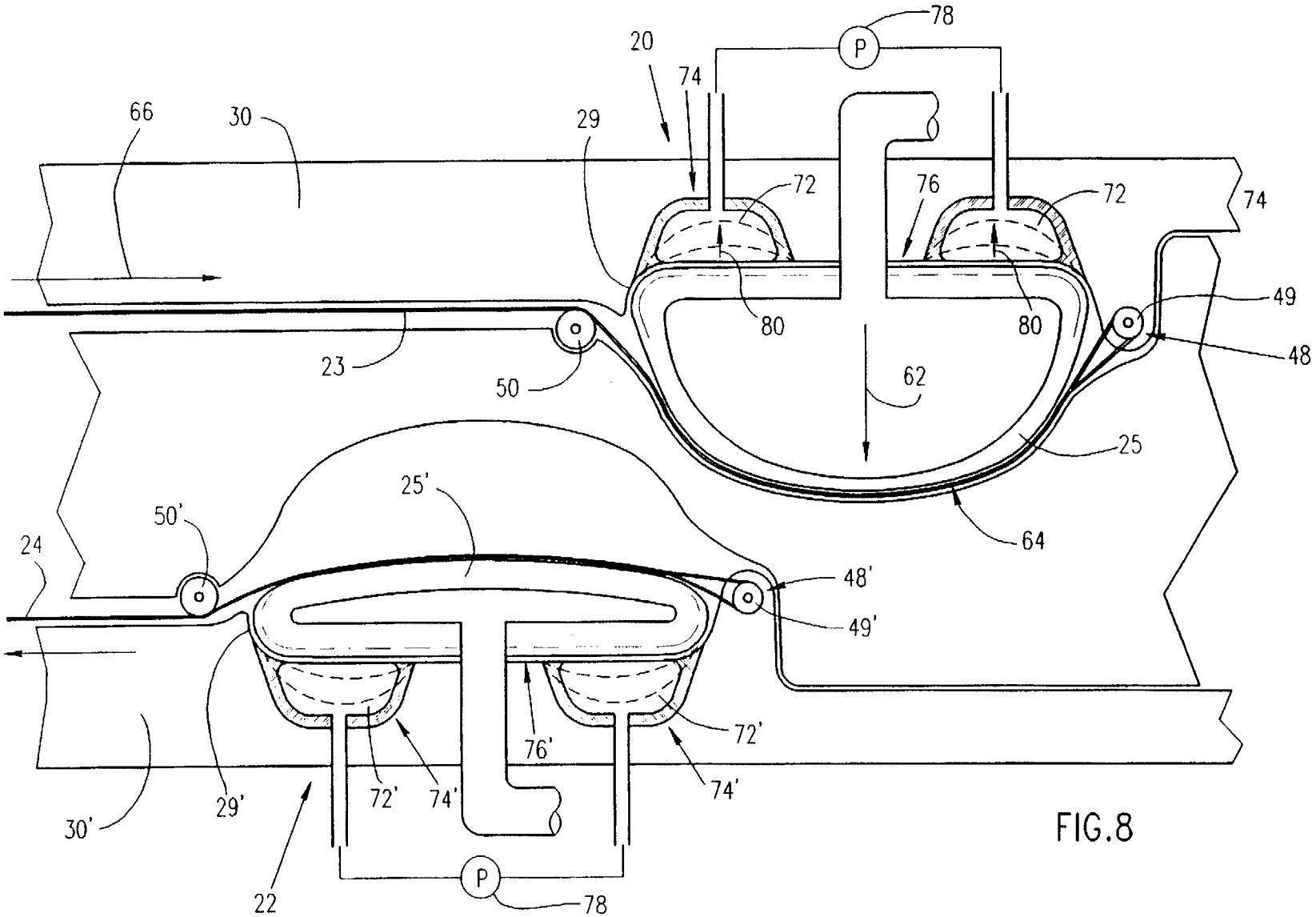
FIGS. 8 and 9 are schematic side view illustrations of the hinge actuator assemblies of FIGS. 3A and 3B but including additional bumper apparatus in accordance with further embodiments of the invention.

In the embodiment illustrated in FIG. 8, fluidic bumpers 72 and 72' are mounted in depressions 74 and 74' formed in respective recesses 29 and 29' of bases 30 and 30', respectively, so as to abut rear sides 76 and 76' of pillows 25 and 25' respectively. According to the present embodiment bumpers 72 and 72' are fluid filled cushions. The internal fluid pressure of the bumpers is maintained by respective fluid pumps 78 as shown. Alternatively, pumps 78 may be replaced by a single fluid pump.

As described above in conjunction with FIGS. 3A and 3B, pressurization of one of the pillows, for example, pillow 25 causes expansion thereof in the direction of arrow 62. Accordingly, bumpers 72 are maintained at a sufficiently high pressure so as to withstand any forces applied thereto by pillow 25 during normal use. However, in order to protect the hinge assembly, bumpers 72 are adapted to permit a rearward expansion of pillow 25, as indicated by arrows 80, in response to a momentary impact force which may be applied to the hinge assembly, and, consequently, also to the force transfer member 23 and pillow 25.

Figure 9:
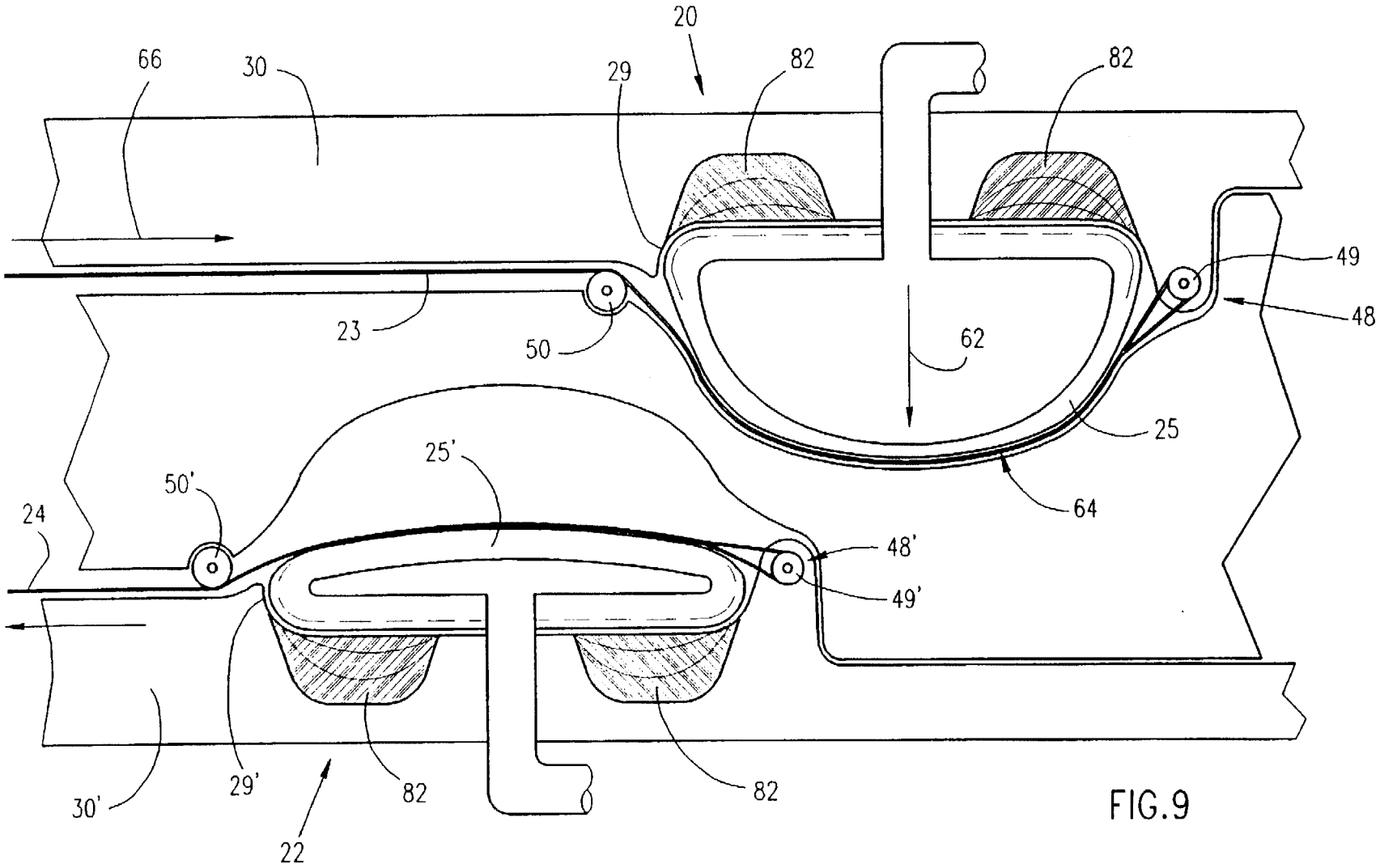

In the embodiment illustrated in FIG. 9, a plurality of bumpers 82 is provided so as to operate in a manner similar to that of bumpers 72, as described above in conjunction with FIG. 8. According to the present embodiment, however, bumpers 82 are formed of a solid, resilient material, substantially as described above in conjunction with bumpers 71.

Figure 10:
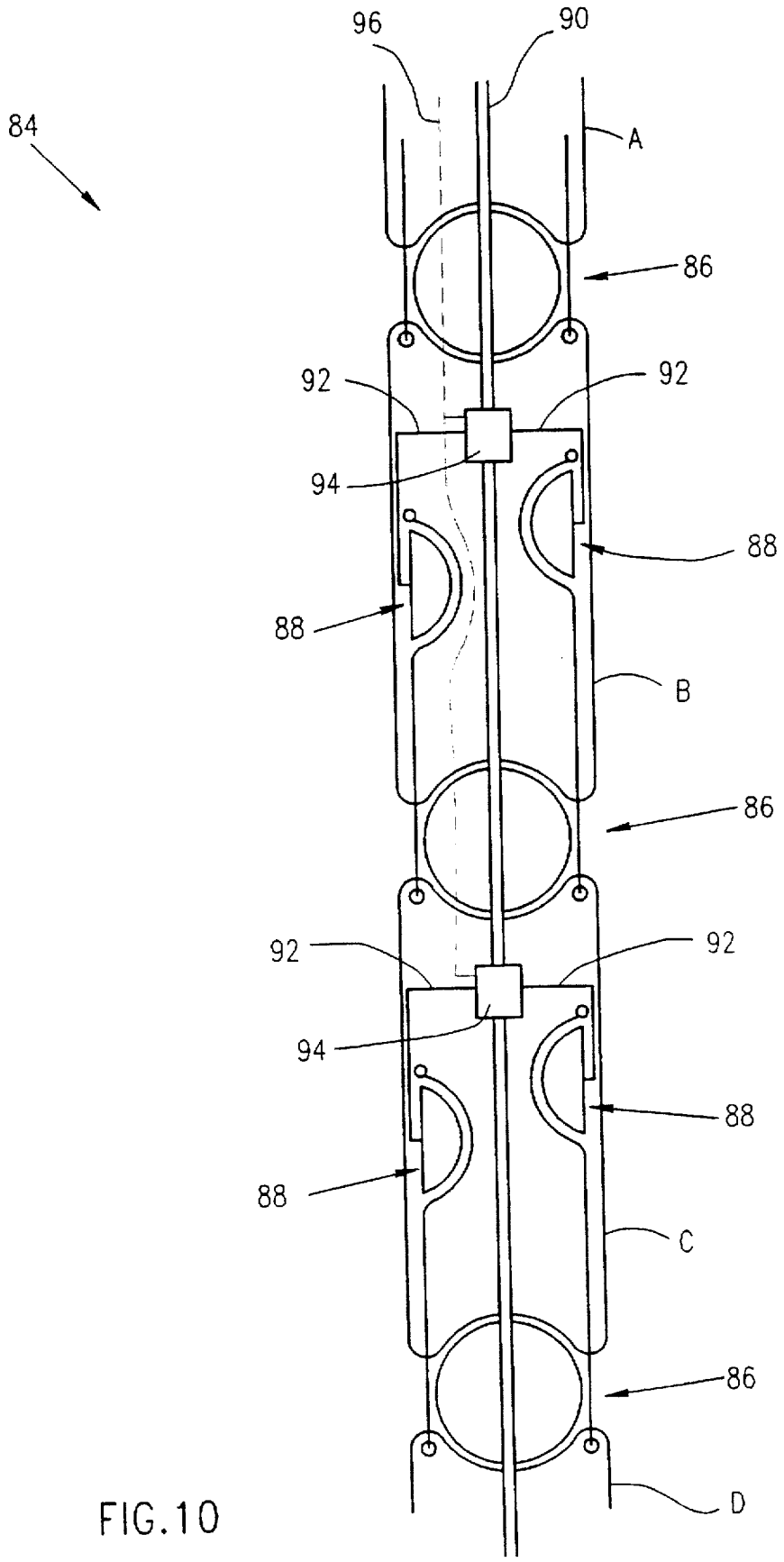
FIG. 10 is a schematic side view illustration of a multiple hinge assembly constructed in accordance with a further embodiment of the invention.

Reference is now made to FIG. 10, in which is illustrated a multiple hinge assembly, referenced generally 84, constructed and operative in accordance with a further embodiment of the invention. Hinge assembly 84 comprises a plurality of hinge members, respectively referenced A, B, C and D attached in series via a plurality of joints 86. Joints 86 may be constructed according to any of the embodiments shown and described above in conjunction with FIGS. 1A–5D.

According to the illustrated arrangement, each of the hinge members may be oriented separately via a pair of fluidic actuator assemblies 88 (shown only for hinge members B and C), whose construction and operation is similar to the construction and operation of fluidic actuator assemblies 20 and 22 described hereinabove in conjunction with FIGS. 3A and 3B.

In the present embodiment, however, orientation adjustment and control of the hinge members is provided via a primary fluidic supply line 90 with which secondary fluidic supply lines 92 interconnect via fluidic selectors 94 controlled via electrical control signals provided along an electrical line 96.

Figure 11:
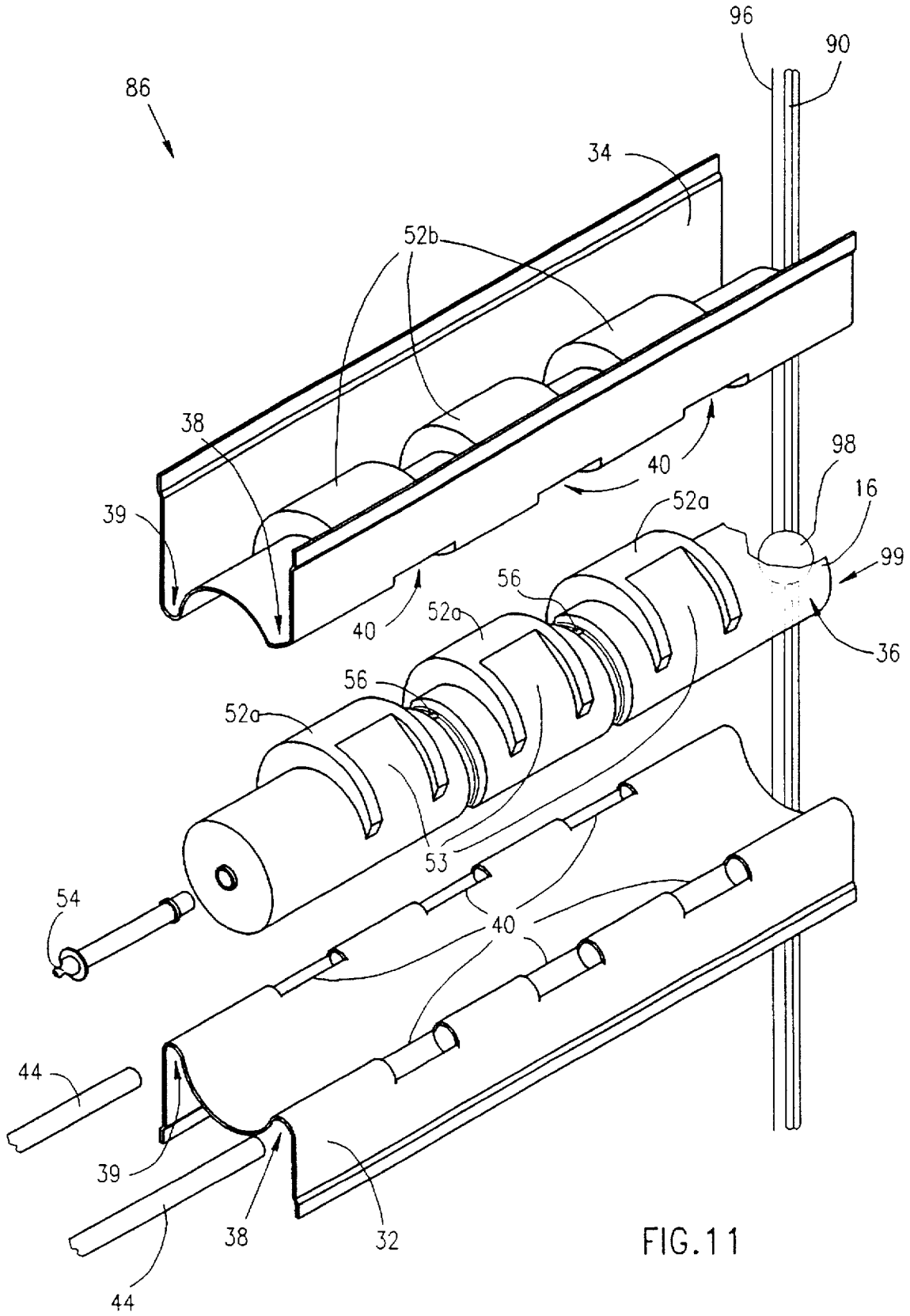
FIG. 11 is an exploded pictorial view of a joint portion of the multiple hinge assembly illustrated in FIG. 10.
Figure 12:
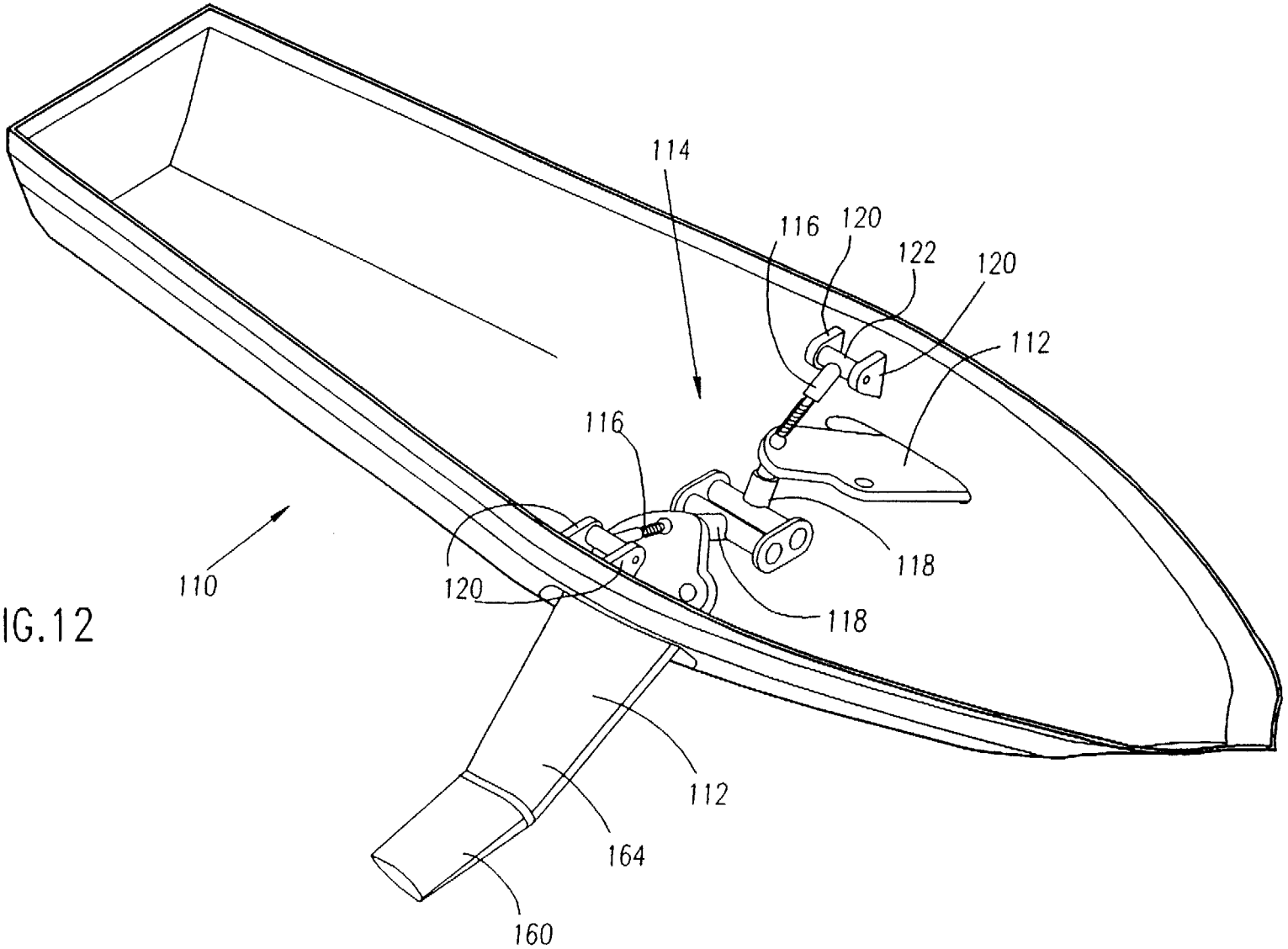
FIG. 12 is a partially schematic, partially pictorial illustration of watercraft including shock absorbers constructed in accordance with an embodiment of the invention and having retractable foils which have adjustable tips and which incorporate the hinge assembly of FIGS. 1A and 1B.
Figure 13A:
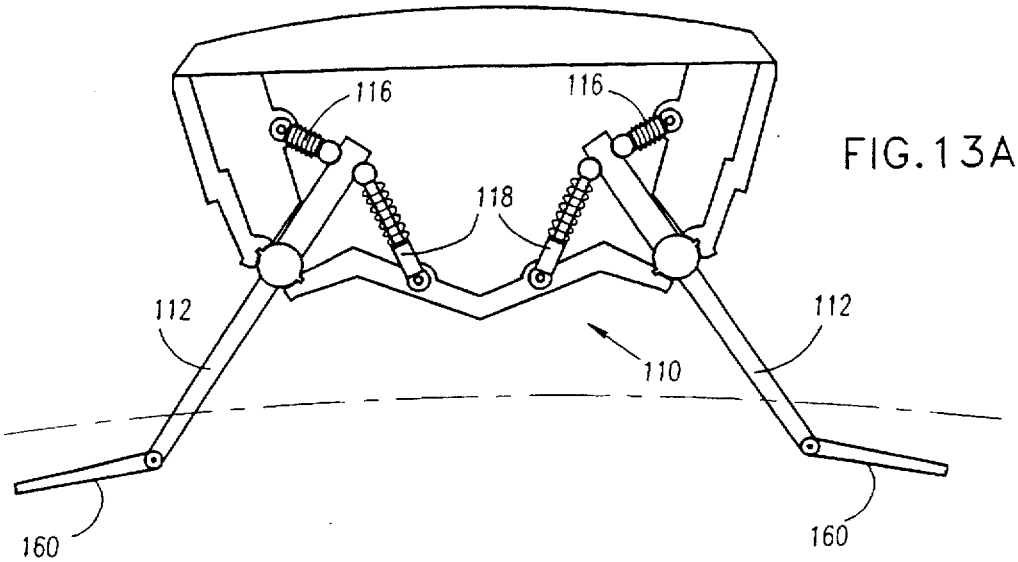
FIGS. 13A, 13B and 13C are illustrations of the operation of the watercraft of FIG. 12 wherein the foils and the shock absorbers are in three different operative orientations.
Figure 13B:
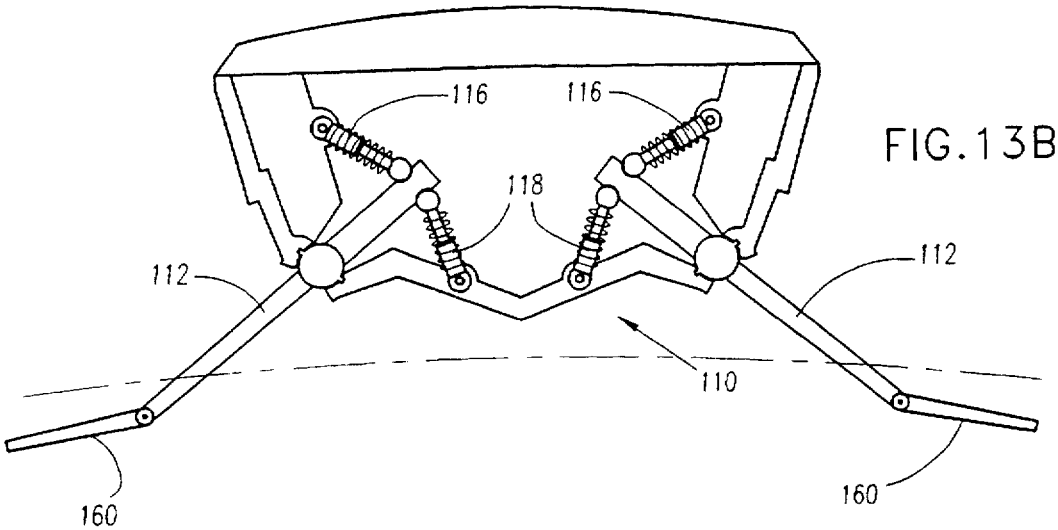
Figure 13C:
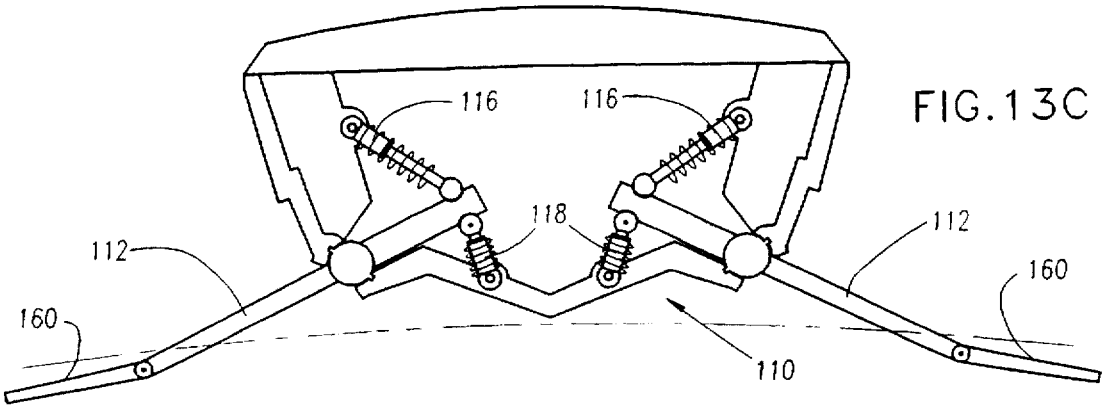
Figure 14A:
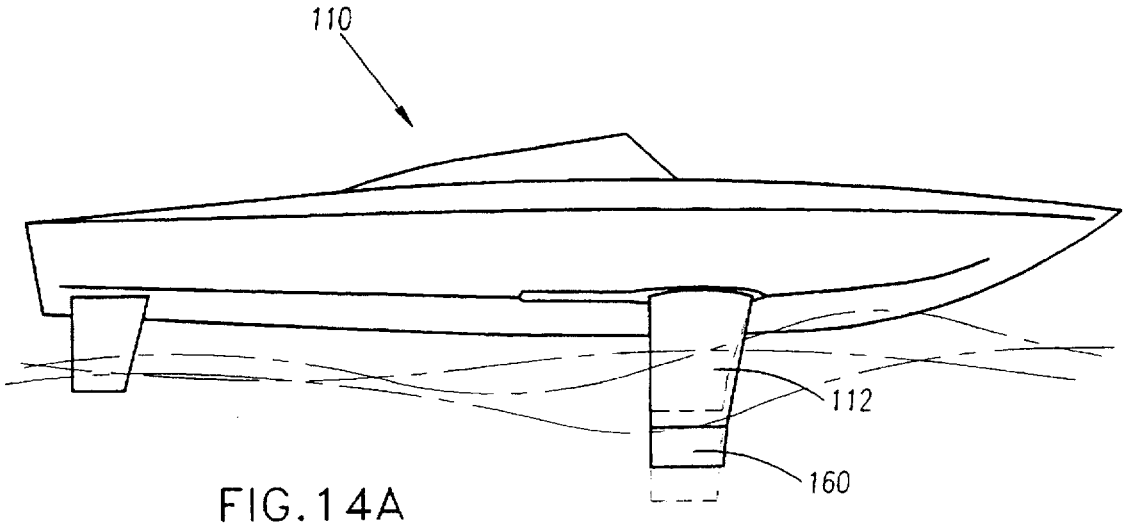
FIGS. 14A and 14B are respective side view and bottom view illustrations of the watercraft of FIG. 12, each of which illustrates the orientations of the foils in the three different operative orientations shown in FIGS. 13A, 13B and 13C.
Figure 14B:
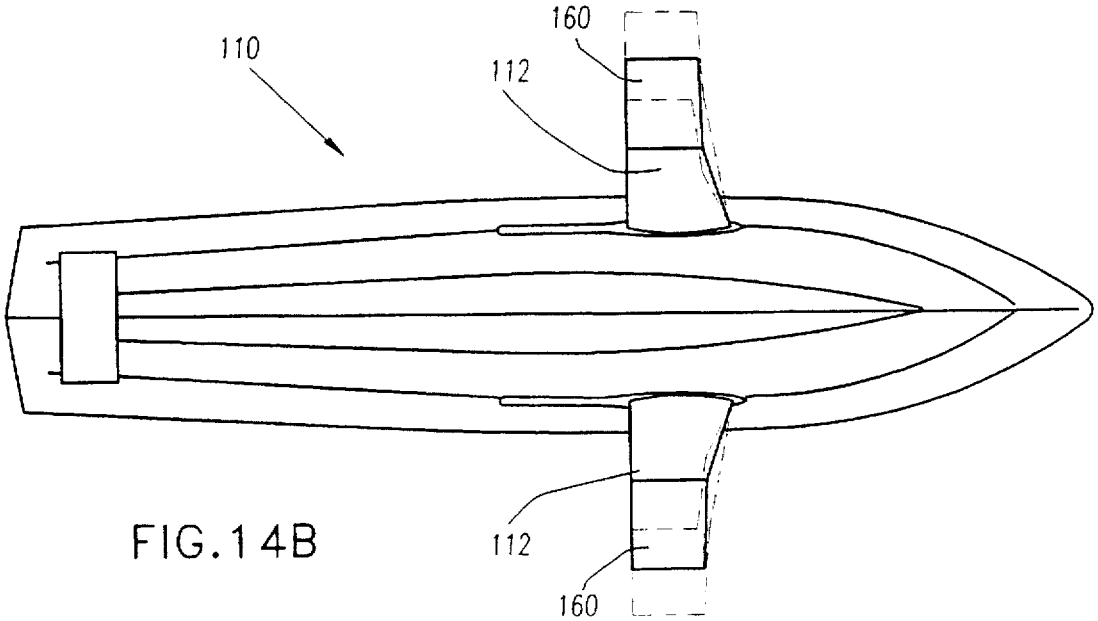

Referring now also to FIG. 11, there is shown, in exploded pictorial form, a joint 86 of the hinge assembly 84 illustrated in FIG. 10, in accordance with one embodiment. In the present embodiment, joint 86 is similar to the arrangement illustrated in FIG. 4C. Accordingly, components of joint 86 similar to those in the arrangement of FIG. 4C are denoted by like reference numerals.

According to the present embodiment, however, a rotation joint 98 of any suitable construction is provided at an end portion 99 of pivot member 16, thereby to mechanically isolate the primary fluidic supply line 90 and the electrical line 96 from stresses arising out of angular adjustments of the hinge members.

It will be appreciated by persons skilled in the art, that both the dual hinge assembly 10 (FIGS. 1A–9) and the multiple hinge assembly 84 (FIG. 10) of the present invention have many different possible applications. These applications include incorporation into mechanical control systems such as used with hydrofoils, airfoils, robot systems, artificial limbs, lifting devices such as cranes, and fish-tail propulsion devices.

Furthermore, among advantages of the hinge assemblies of the present invention are the capability to be incorporated into an integral hinge-actuator assembly, an absence of fasteners for attaching hinge assemblies of the present invention to surfaces that it is sought to rotate, the provision of surfaces having low drag coefficients for aero- and hydrodynamic application, shock resistance, a relatively small number of components and easy assembly.

In accordance with a preferred embodiment of the invention, the hinge assembly of the invention is incorporated into a system for controlling the angular orientation of the tip of a hydrofoil constructed and operative substantially as illustrated and described hereinbelow in conjunction with any of FIGS. 12–26.

Reference is now made to FIGS. 12, 13A, 13B, 13C, 14A and 14B, which illustrate a watercraft which comprises a hull 110 and at least one pair of hydrofoils 112 associated with the hull for engagement with water. Shock absorbing apparatus is provided for absorbing mechanical shocks received from the waves and preventing them from being fully transferred to at least a portion of the hull. According to a preferred embodiment of the invention, each foil 112 comprises a main portion 164 and a tip portion 160. The tip portion 160 is arranged for angular adjustment relative to the main portion 164 via a hinge assembly constructed and operative substantially as described hereinabove in conjunction with any of the embodiments shown and described above in conjunction with FIGS. 3A–5C.

The shock absorbing apparatus typically comprises at least one shock absorber 116 associated with each foil 112 to absorb upwardly directed forces imparted thereto as a result of upward wave motion, and at least one shock absorber 118 associated with each foil to absorb downwardly directed forces imparted thereto as a result of the post-wave descending motion of the craft.

It is noted that the shock absorbers 116 and 118 are preferably pivotably mounted with respect to the foils 112 and are mounted onto the hull by means of brackets 120 engaging a pivotably mountable base 122. The shock absorbers may be of any suitable construction and may be commercially available mechanical, hydraulic or pneumatic shock absorbers, such as Catalog No. R1061 of Monroe, Inc., U.S.A; or such as the 8000 Series of shock absorbers marketed by Koni, Holland.

The extension and retraction of the shock absorbers 116 and 118 with different relative orientations of the foils 112 can readily be seen from a consideration of FIGS. 13A–13C and 14A–14B which illustrate two extreme orientations and an intermediate orientation of the foils 112 relative to the hull 110.

In accordance with the teachings of applicant's U.S. Pat. No. 4,715,304, the foils may be retractable.

Reference is now made to FIGS. 15–17B, which illustrate fluidic apparatus for governing the orientation of the tip 160 of a hydrofoil 112 relative to the main portion 164 of the hydrofoil.

A foil mounting pin 201 has integrally formed therein a fluidic valve 202 associated with a fluid source (not shown). The pin 201 is pivotably seated in a socket 207 integrally formed in a wall 208 of the hull. Also integrally formed in wall 208 is a cavity 211 for seating a ball pivot protrusion 205, integrally formed in hydrofoil 112. Formed in the wall of ball pivot protrusion 205 is an elongated groove 206 (FIG. 18).

Figures 15, 16, 18:
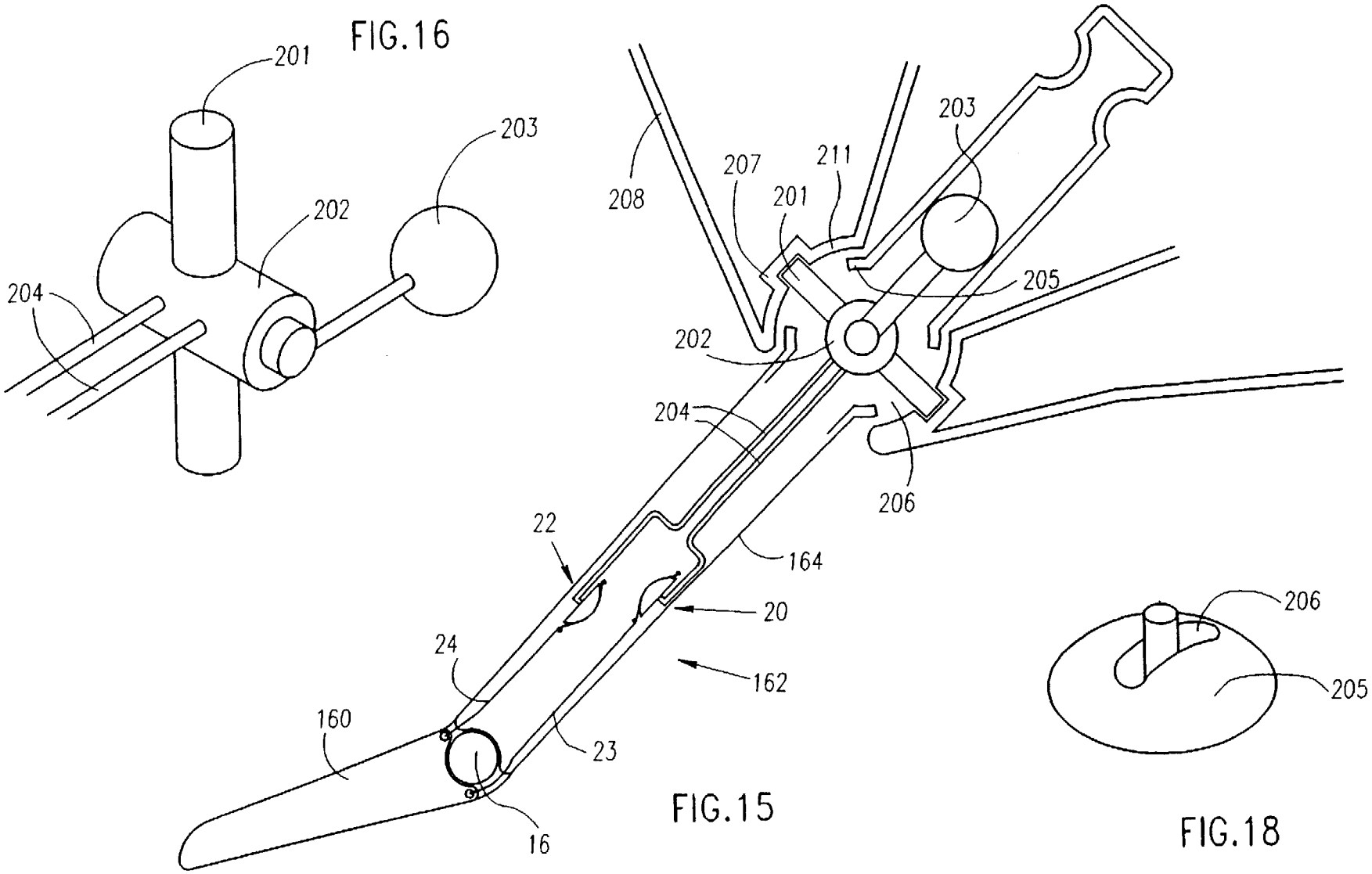
FIG. 15 is a simplified illustration of apparatus for mounting a foil and for governing the orientation of the tip thereof.
FIG. 16 is a simplified illustration of part of the apparatus of FIG. 15.
FIG. 18 is a simplified pictorial illustration of a portion of the apparatus of FIG. 15.
Figure 17A:
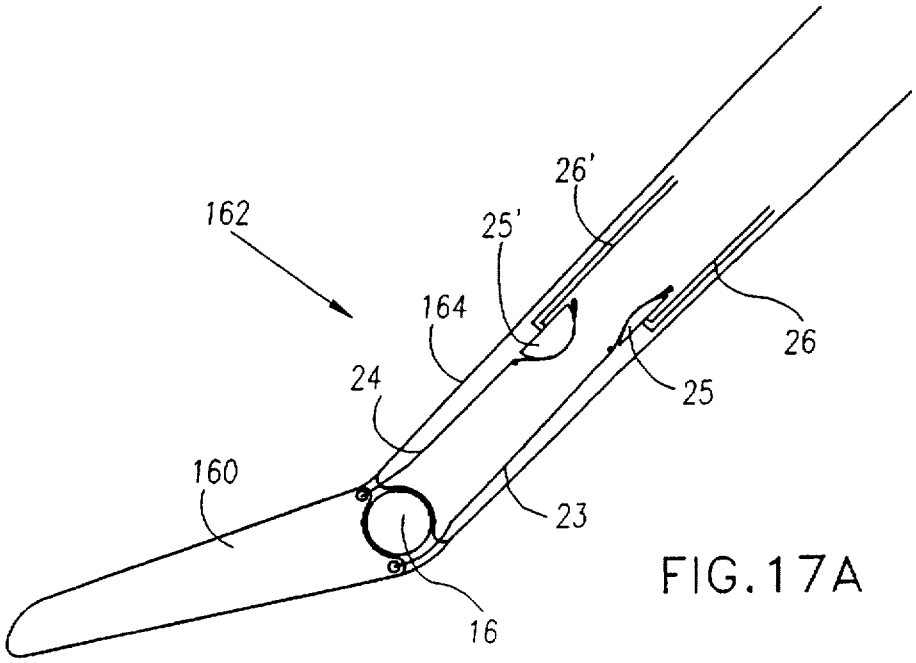
FIGS. 17A and 17B are illustrations of part of the foil of FIG. 15 in respective partially folded and straight orientations.
Figure 17B:
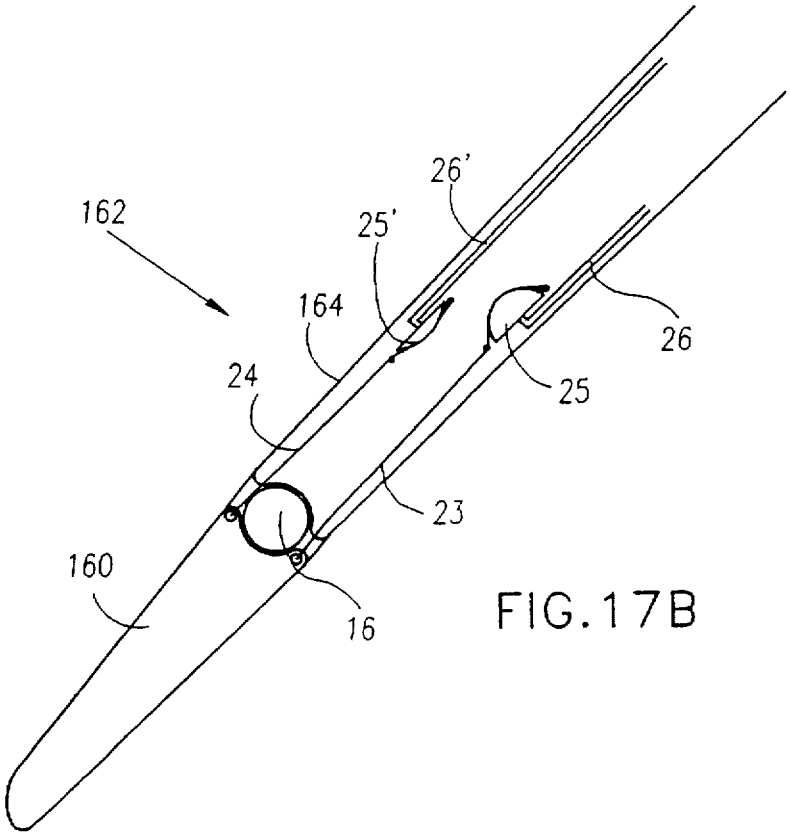

As the hydrofoil 112 changes its angle in the plane of FIG. 15 and the shock absorbers are operative, pivot protrusion 205 moves relative to pin 201 causing pin 201 to be in different relative positions along groove 206. This hydrofoil motion forces a valve control handle 203 to change its position relative to valve 202, thus effecting opening and closing of the valve. Valve 202 is connected via conduits 204 to fluidic actuators 20 and 22, substantially as described hereinabove in conjunction with FIGS. 3A and 3B. Actuators 20 and 22 activate respective force transfer members 23 and 24 which effect a pivotal change in position of the tip 160 of hydrofoil 112 relative to main portion 164 thereof about a pivot member 16.

Reference is now made to FIGS. 19A, 19B, 20A, 20B, 20C, 21A, 21B, 22 and 23 which illustrate watercraft which comprises a hull 310 and at least one pair of hydrofoils 312 associated with the hull for engagement with water, and wherein fluid filled resilient shock absorbing apparatus is provided. The shock absorbing apparatus is operative to absorb mechanical shocks received from the waves and to prevent the shocks from being fully transferred to at least a portion of the hull.

Preferably, the shock absorbing apparatus comprises a pair of fluid filled pillow assemblies 316 associated with each foil 312 to absorb upwardly directed forces imparted thereto as a result of upward wave motion, and downwardly directed forces imparted thereto as a result of the post-wave descending motion of the craft.

Pillow assemblies 316 each typically comprise a plurality of fluid filled pillows 319, typically formed of suitable conventional rubber or plastic materials and filled with gas or a liquid. Normally the interiors of the fluid filled pillows of each assembly 316 are not interconnected. Rather, for each pillow assembly 316, each pair of corresponding individual pillows 319 lying on opposite sides of a foil 312 are interconnected by a suitable conduit 320 and valve 324. Valves 324 govern the rate of fluid flow between the pillows of each pair and thus the amount and rate of damping produced by the assemblies. Valves 324 may be manually or automatically controlled to vary the operating parameters of the shock absorbing apparatus for optimum performance under various conditions.

According to one embodiment of the invention, separate valves and separate associated command wiring may be provided for the individual pillows. This also may be the case for the embodiments of FIGS. 24 and 27.

Figure 19B:
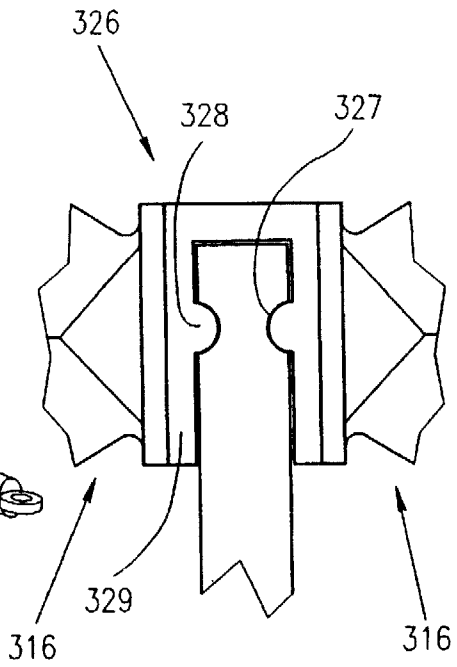
FIGS. 19A and 19B are respective general and detailed illustrations of the use of an alternative embodiment of shock absorbers in accordance with an alternative embodiment of the invention.
Figure 19A:
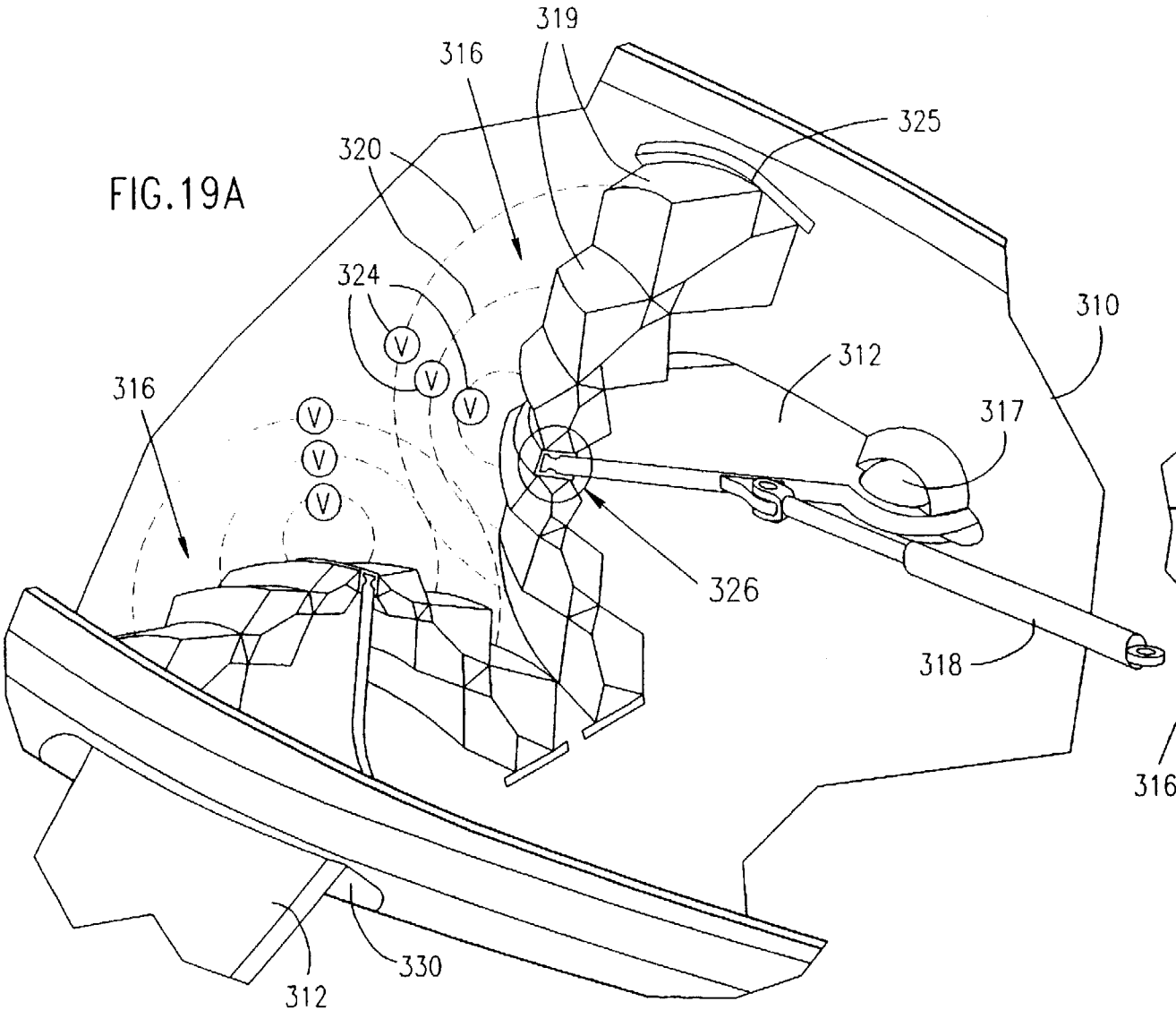
Figure 20A:
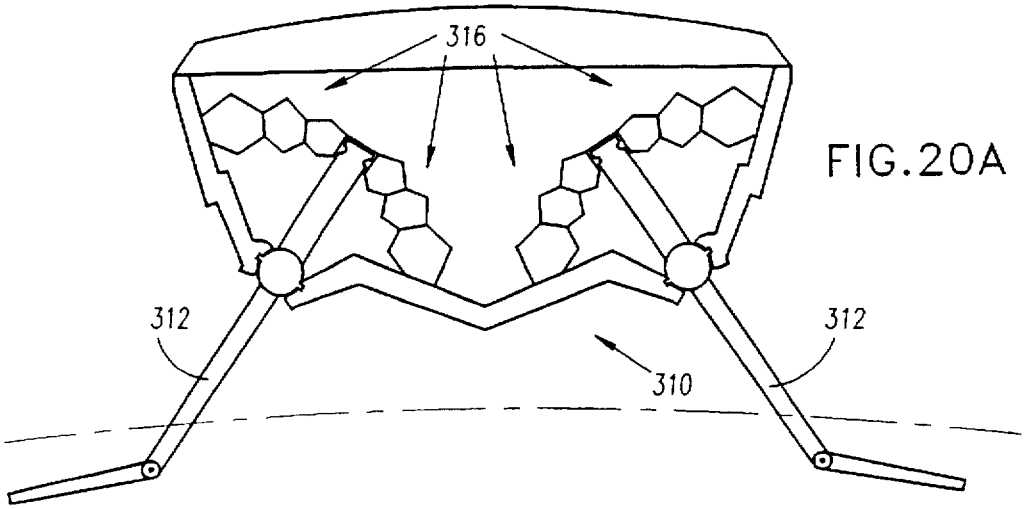
FIGS. 20A, 20B and 20C are illustrations of the operation of the apparatus of FIGS. 19A and 19B wherein the foils and the shock absorbers are in three different operative orientations.
Figure 20B:
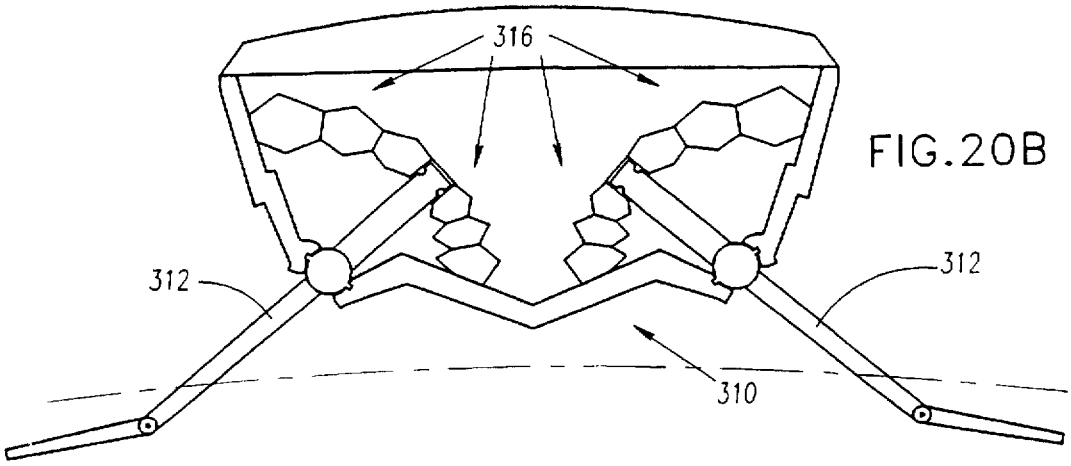
Figure 20C:
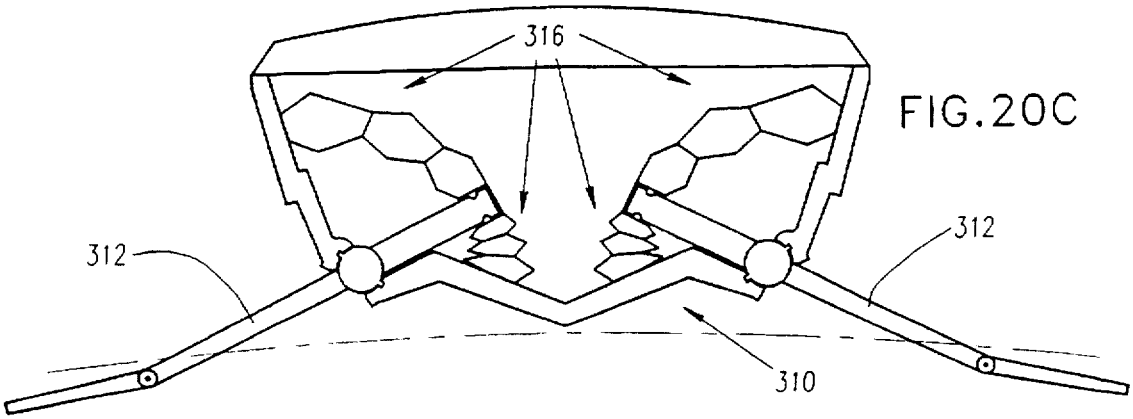
Figure 21A:
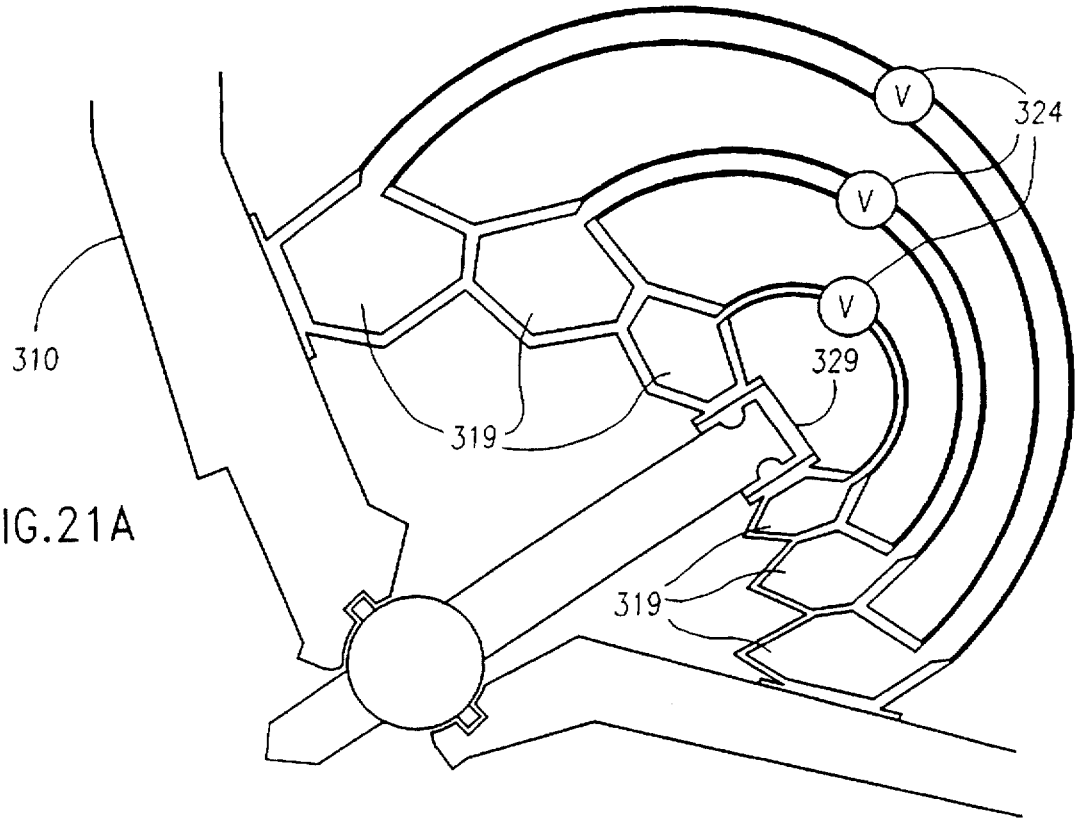
FIGS. 21A and 21B are respective side sectional view illustrations of the apparatus of FIGS. 19A and 19B, each of which illustrates the orientations of the foils in a different operative orientation.
Figure 21B:
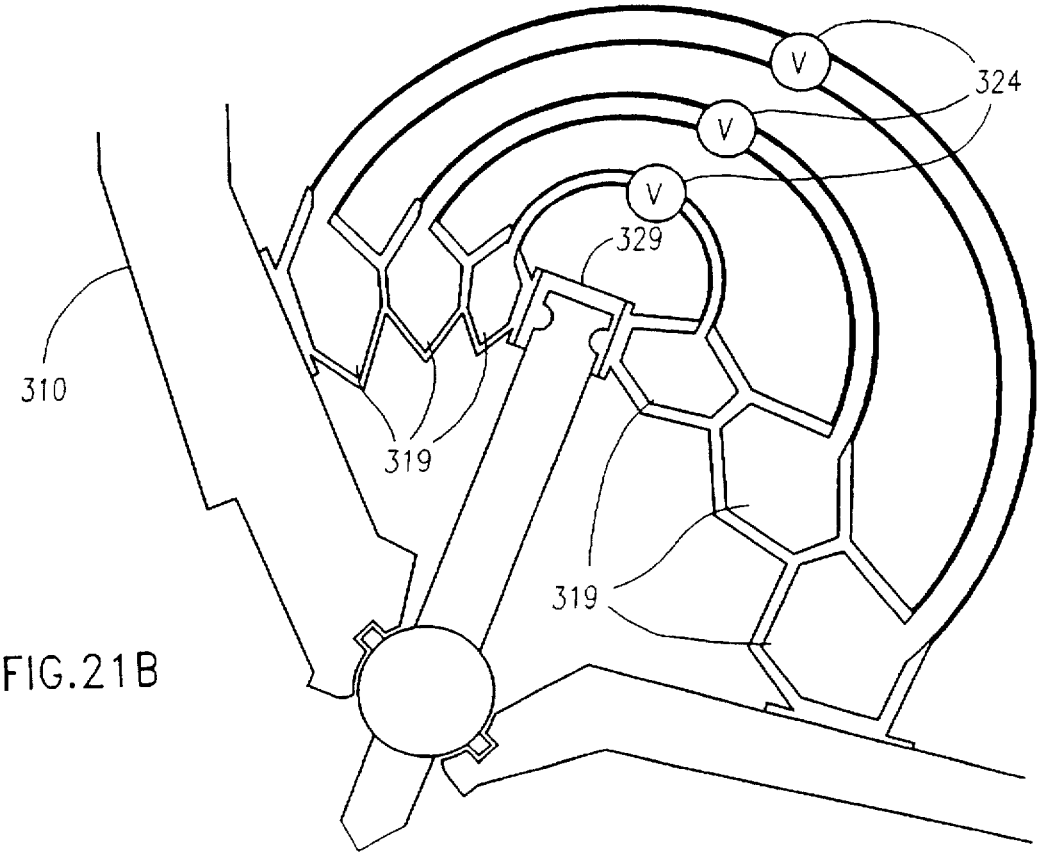
Figure 22:
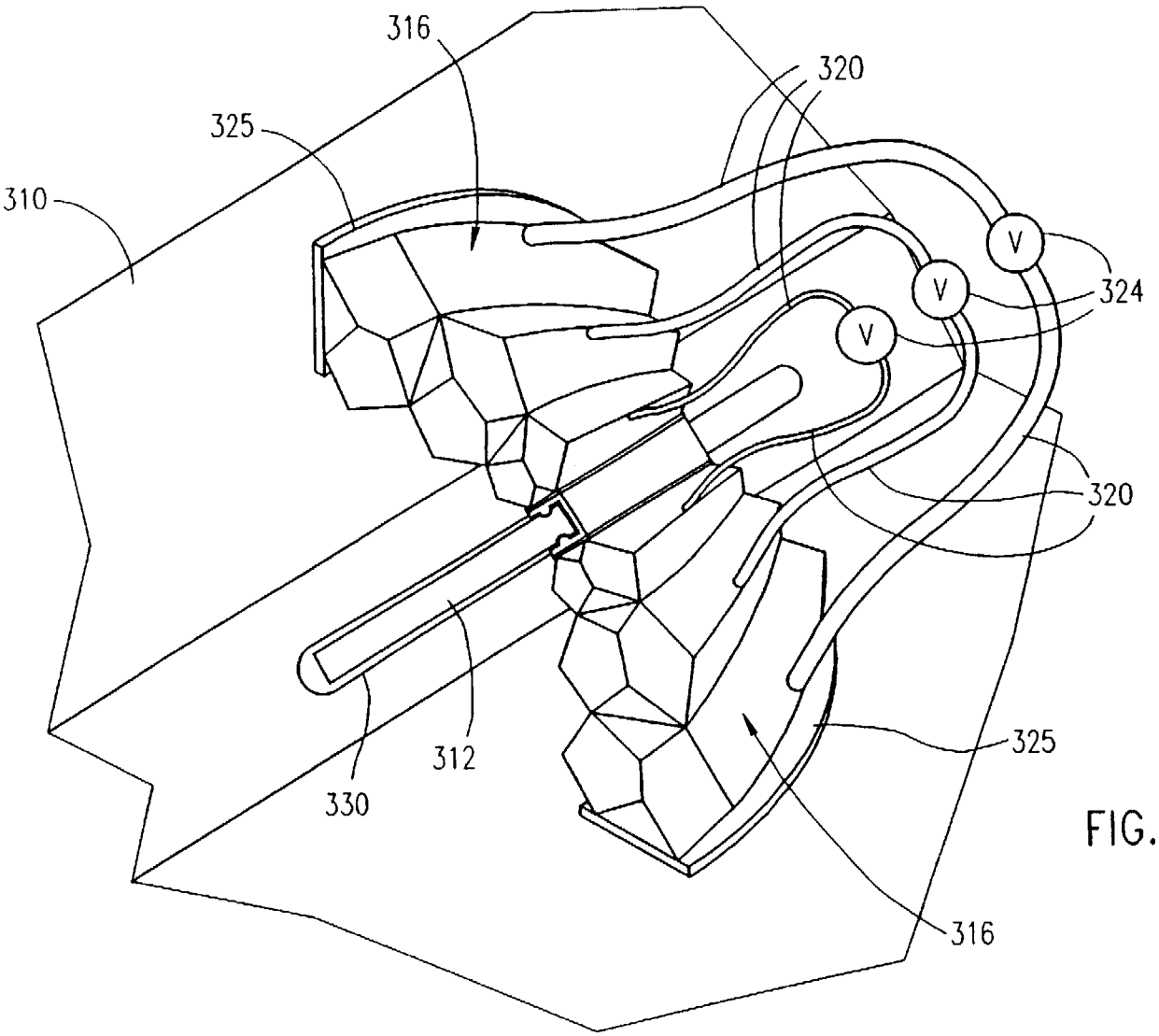
FIG. 22 illustrates part of shock absorber equipped apparatus for foils which is useful in the embodiment of FIG. 15.

Pillow assemblies 316 are mounted onto the hull 310 by means of brackets 325 and onto the foils 312 by means of a mounting assembly 326, which is illustrated in FIG. 19B. It is seen from FIG. 19B that an elongate curved recess 327 extending along the peripheral edge of foil 312 is slidably engaged by low friction solidified filling material 328, which forms part of a bracket 329 to which both of pillow assemblies 316 are mounted.

The slidable engagement between material 328 and foil 312 is designed to accommodate pivotal motion of the foils 312 about ball pivots 317 in response to actuation of a piston and cylinder combination 318 which is operatively connected thereto so as to provide retraction of the foils.

The extension and retraction of the pillow assemblies 316 with different relative orientations of the foils 312 can readily be seen from a consideration of FIGS. 20A–20C, 21A and 21B which illustrate two extreme orientations and an intermediate orientation of the foils 312 relative to the hull 310.

In accordance with the teachings of applicant's U.S. Pat. No. 4,715,304, the foils may be retractable as by piston and cylinder assembly 318. They are preferably fully retractable into the hull 310 via a slot 330.

Figure 23:
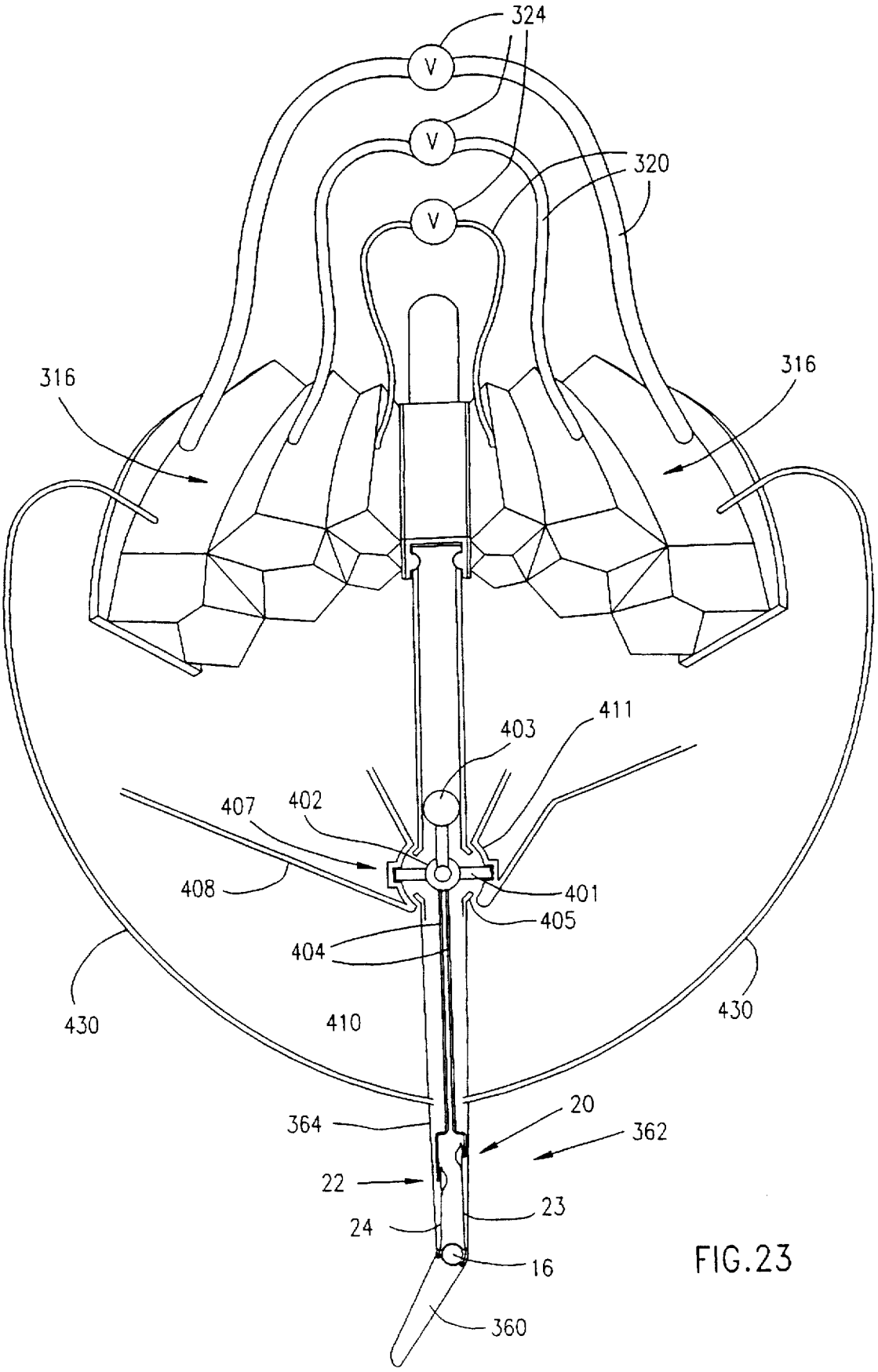
FIG. 23 is a simplified illustration of apparatus for mounting a foil and for governing the orientation of the tip thereof in accordance with another embodiment of the present invention.

Reference is now made to FIG. 23, which illustrates an alternative embodiment of fluidic apparatus for governing the orientation of the tip 360 of a hydrofoil 362 relative to the main portion 364 of the hydrofoil.

A foil mounting pin 401 has integrally formed therein a valve 402 associated with a fluidic pressure source (not shown). The pin 401 is pivotably seated in a socket 407 integrally formed in a wall 408 of the hull. Also integrally formed in wall 408 is a cavity 411 for seating a ball pivot protrusion 405, integrally formed in hydrofoil 362, similarly to the embodiment of FIGS. 15 and 18.

As the hydrofoil 362 changes its angle in the plane of FIG. 23 and the shock absorbing apparatus is operative, hydrofoil motion forces a valve control handle 403 to change its position relative to valve 402, thus effecting opening and closing of the valve. Valve 402 is connected via conduits 404 to fluidic actuators 20 and 22, substantially as described hereinabove in conjunction with FIGS. 3A and 3B.

Actuators 20 and 22 activate respective force transfer members 23 and 24 which effect a pivotal change in position of the tip 360 of hydrofoil 362 relative to main portion 364 thereof about a generally cylindrically shaped pivot member 16.

In accordance with a preferred embodiment of the invention, actuators 20 and 22 each receive a fluidic input from a respective one of the pillow assemblies 316 via a respective conduit 430.

The apparatus of FIG. 23 enables the angular orientation of the, tip 360 relative to the water surface to be generally maintained notwithstanding changes of the orientation of the main portion 364.

Figure 24:
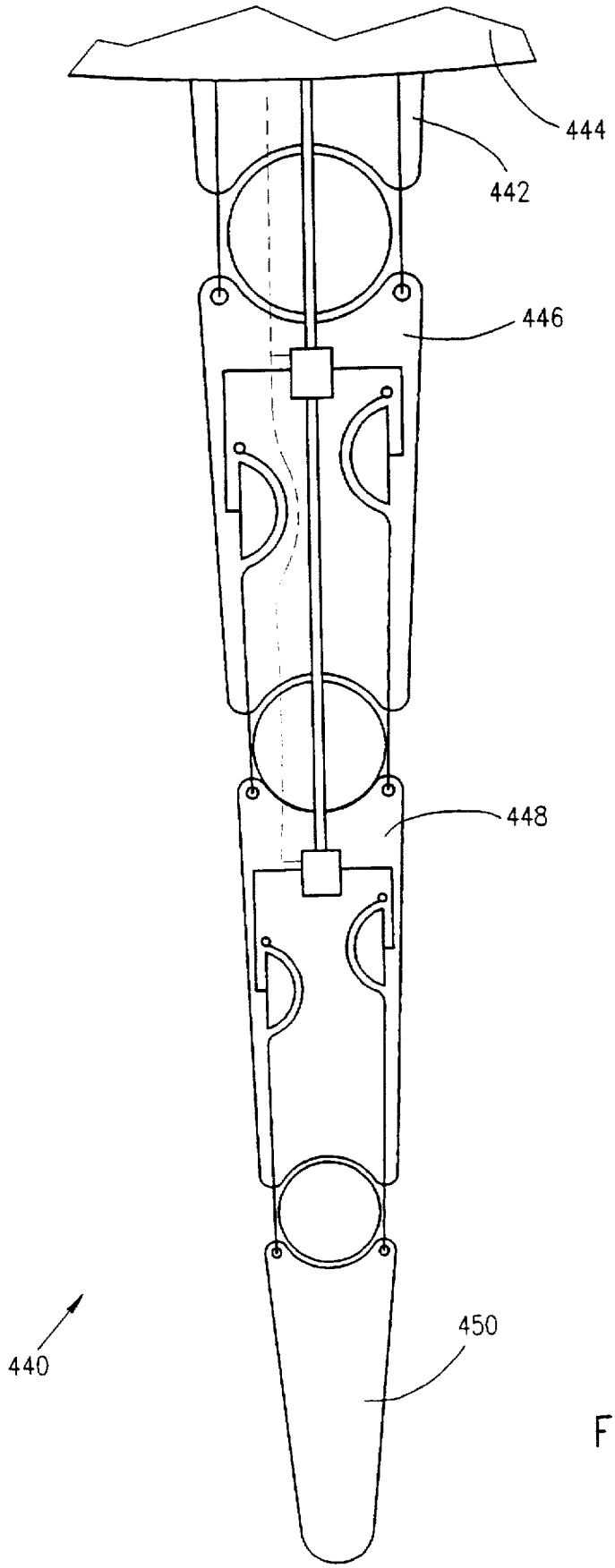
FIG. 24 is a schematic cut-away view of a multiple-jointed foil constructed in accordance with a further embodiment of the invention.

Reference is now made to FIG. 24, which is a schematic cut-away illustration of a multiple-jointed foil, referenced generally 440, constructed in accordance with a further embodiment of the invention. Foil 440 has a main portion 442 attached to a portion 444 of a craft and further has, in the present example, first, second and third adjustable portions, respectively referenced 446, 448 and 450. Third adjustable portion 450 is a tip portion.

The construction and operation of foil 440 are generally similar to the construction and operation of multiple hinge assembly 84 and are, therefore, not described herein in detail. It will be appreciated, however, that the precise configuration of individual foil portions is selected so as to minimize the drag of the foil. According to one embodiment of the invention the foil is a hydrofoil. According to an alternative embodiment of the invention, however, the foil is an airfoil.

Figure 25:
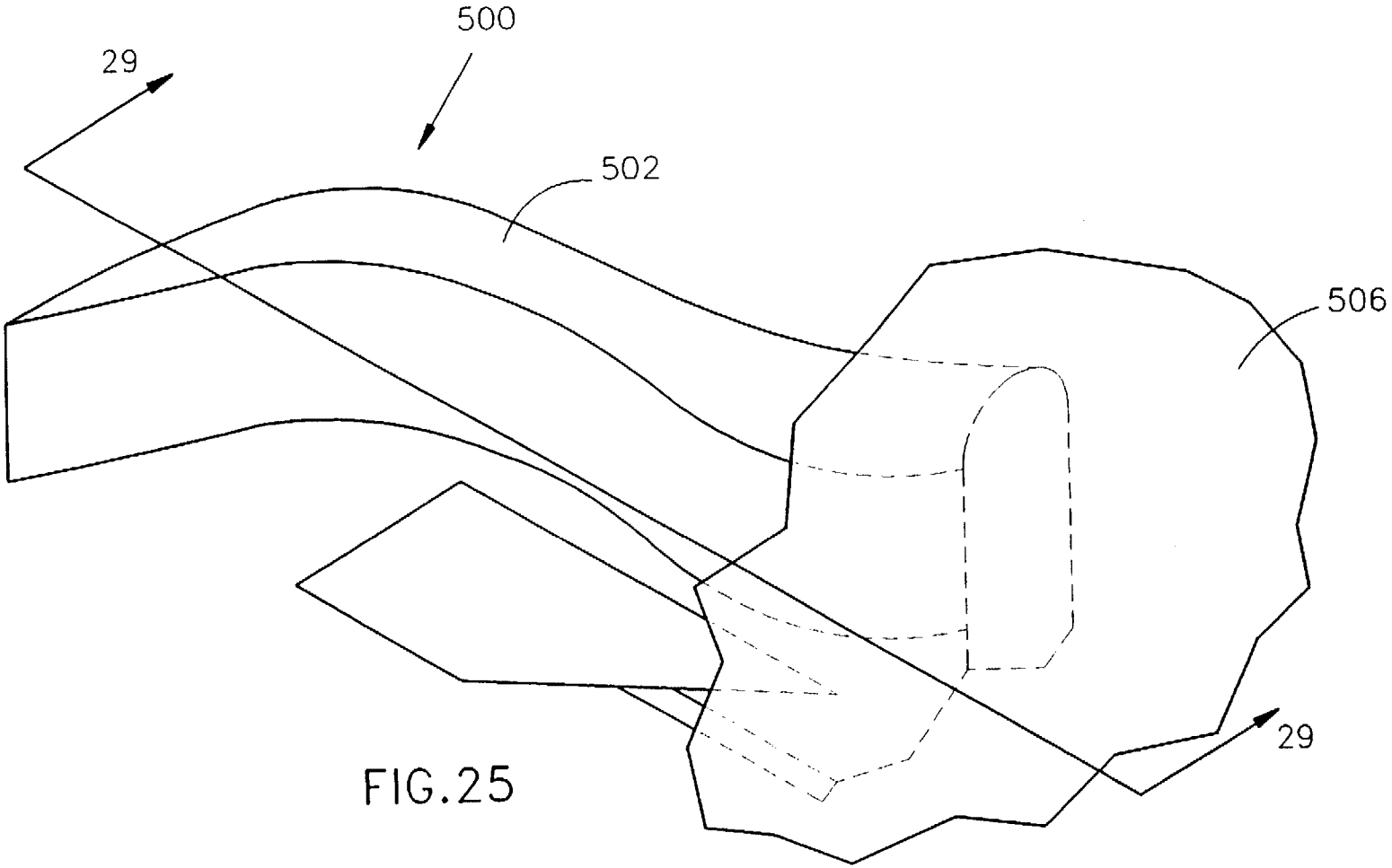
FIG. 25 is a pictorial illustration of an undulating hinged propulsion assembly for use in a watercraft, and employing the multiple hinge assembly of FIG. 10.
Figure 26:
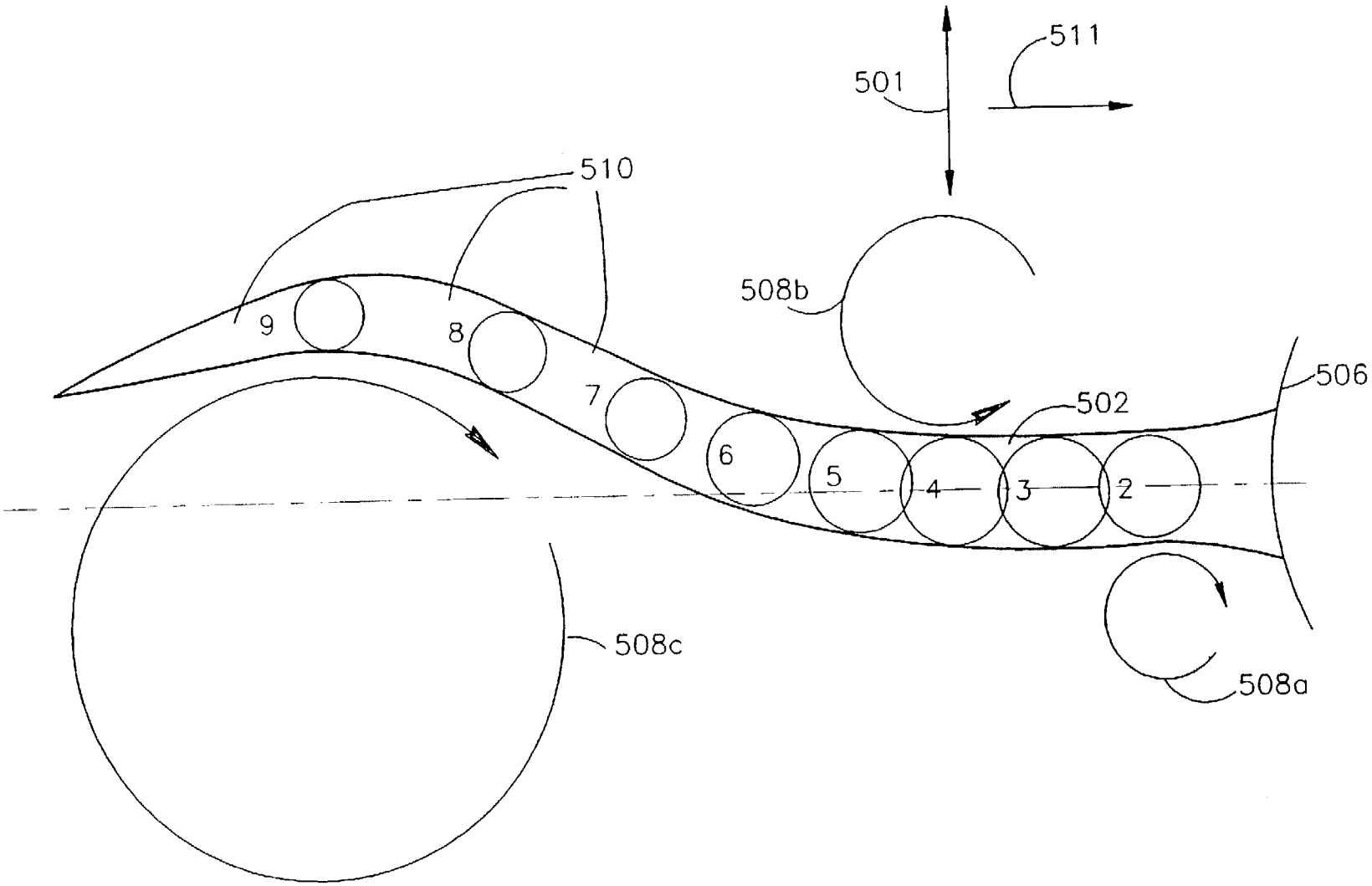
FIG. 26 is a top section illustration of the assembly of FIG. 25, taken along the line 29—29 therein.
Figure 27:
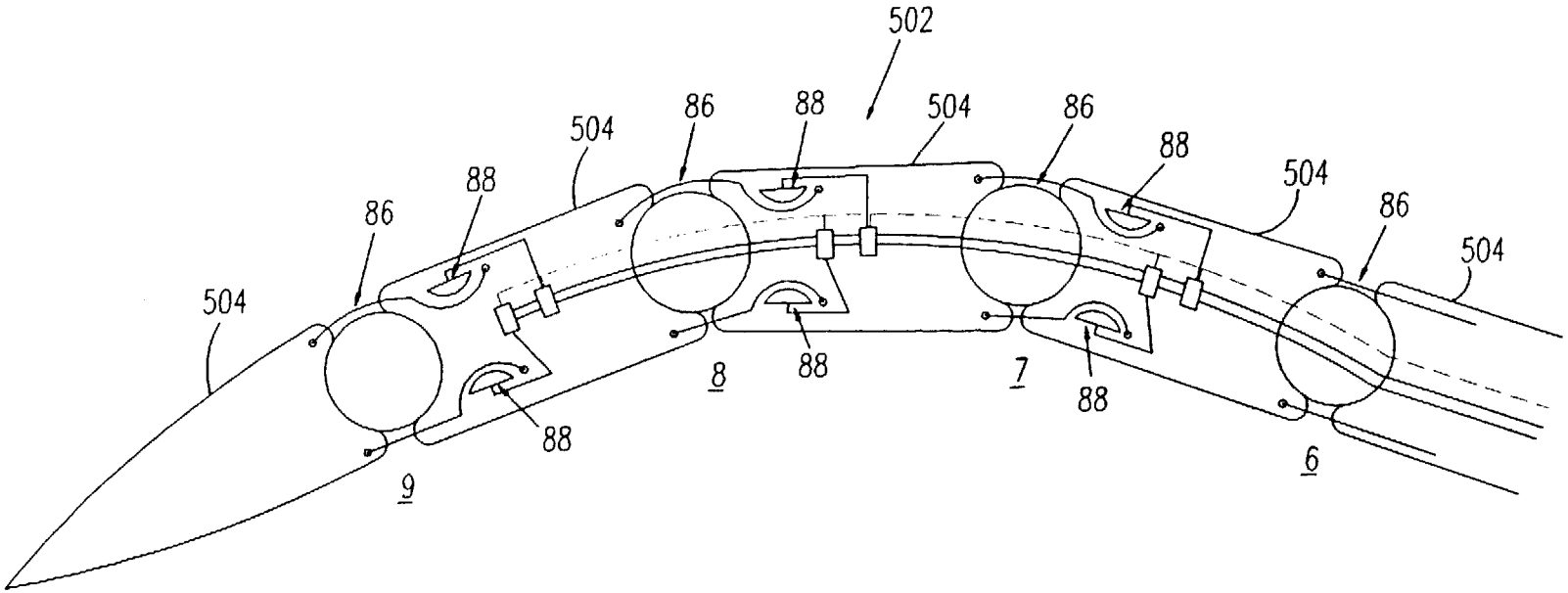
FIG. 27 is a more detailed view of the assembly illustrated in FIG. 26, showing operation thereof.

Reference is now made to FIGS. 25, 26 and 27, which illustrate an undulating hinged propulsion assembly, referenced generally 500, for undersea use with a watercraft. Assembly 500 employs the multiple hinge assembly 84 (FIG. 10) described hereinabove, components of which are not specifically described again herein.

Propulsion assembly 500 is in the form of a fishtail 502 which produces thrust by undulating along an axis 501 perpendicular to the forward motion of the fishtail. Fishtail 502 is typically comprised of a multiplicity of hinge members 504 which are assembled as illustrated in FIG. 27 and in accordance with the hereinabove-described hinge assembly 84 of FIG. 10. The hinge joints 86 are numbered 2–9 in FIG. 26, the first joint being the location of attachment of the assembly 500 to the hull 506 of a watercraft.

Fluidic actuator assemblies 88 are controlled via a command center such that they operate in unison to produce undulations. As is known in the art, the undulation and the forward motion of the watercraft produce eddies 508 (FIG. 26) staggered along the sides of the fishtail 502.

As seen in FIG. 26, each eddy 508 begins as an eddy 508*a* near joints 1 and 2. This happens because the fishtail 502 drags with it as a wake the water near joints 1 and 2, giving the water a rotational motion.

The undulation of the fishtail 502 causes it to travel along the boundary of the eddy 508*a*, which remains stationery in the water. The fishtail 502 returns to eddy 508*a* at a location further along the fishtail 502, in a region of concavity such as at joints 4–6. The fishtail harnesses the eddy and pulls it along so as to impart more rotational energy thereto. This amplifies the eddy to the size shown in eddy 508*b*. This process continues such that the eddies 508 along the body of the fishtail 502 become progressively larger.

The final eddy, shown as an eddy 508*c*, is typically quite large. The end portion 510 of the fishtail 502, at joints 7–9, typically grabs the eddy 508*c* when the end portion 510 is oriented such that a considerable forward thrust component exists. The forward direction is defined by the arrow 511 in FIG. 26.

The water on the eddy or pressure side of the end portion 510 typically moves fairly slowly, while the water on the non-eddy or suction or leeward side of the end portion 510 moves more quickly. Thus there is created a lift vector in a direction having a major component in the direction of forward motion, transferring energy from the eddy 508*c* to the fishtail 502, thereby to give forward thrust to the watercraft.

Optionally, eddies may be initially introduced by artificial means such as nozzles.

It is appreciated that propulsion with undulation is possible even with a single hinge, having two surfaces. However, the propulsion becomes more efficient as more surface segments are provided.

Figure 28A:
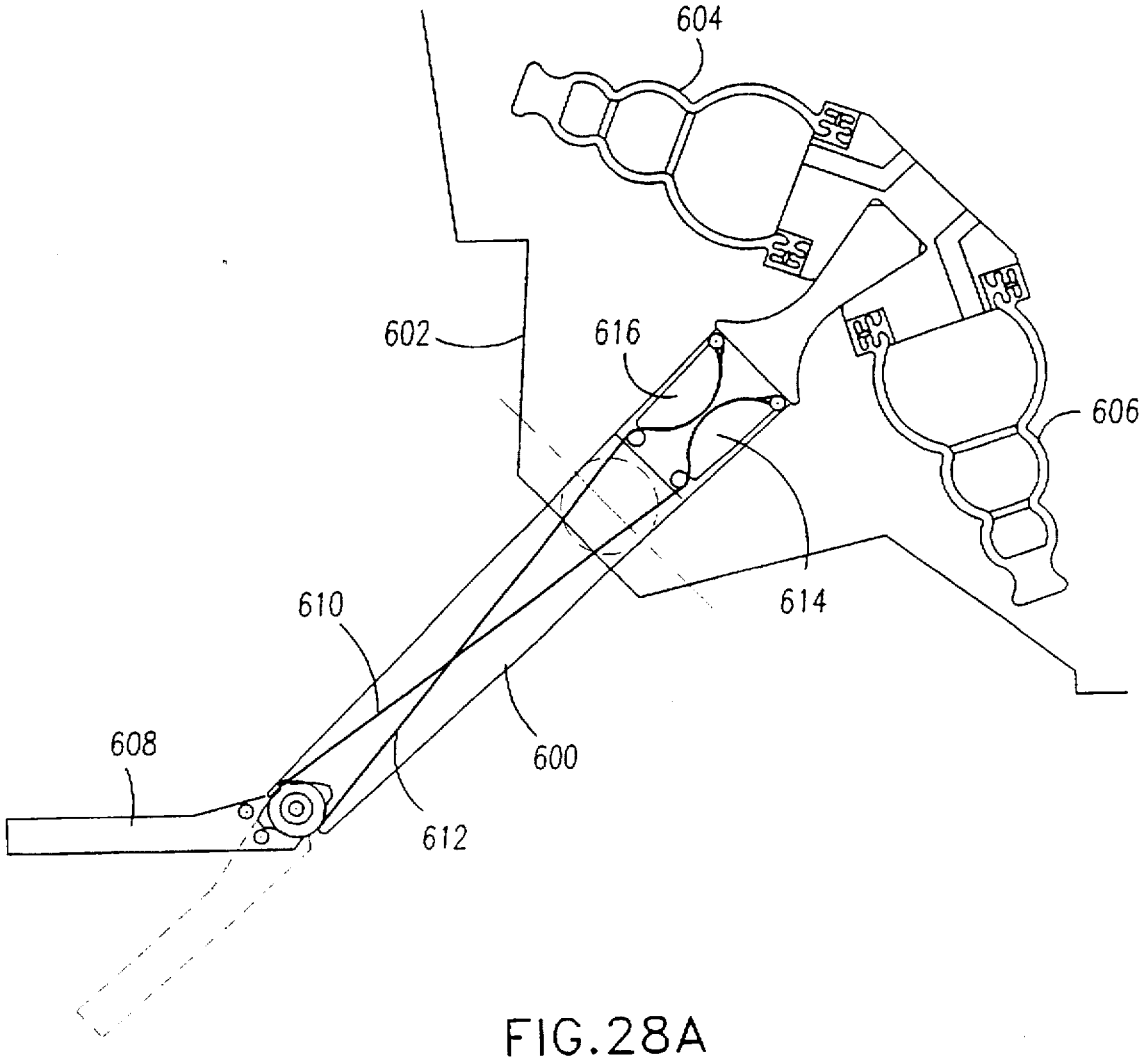
FIGS. 28A, 28B and 28C are simplified illustrations of a shock absorber equipped foil assembly constructed and operative in accordance with another preferred embodiment of the invention in three alternative operative orientations.
Figure 28B:
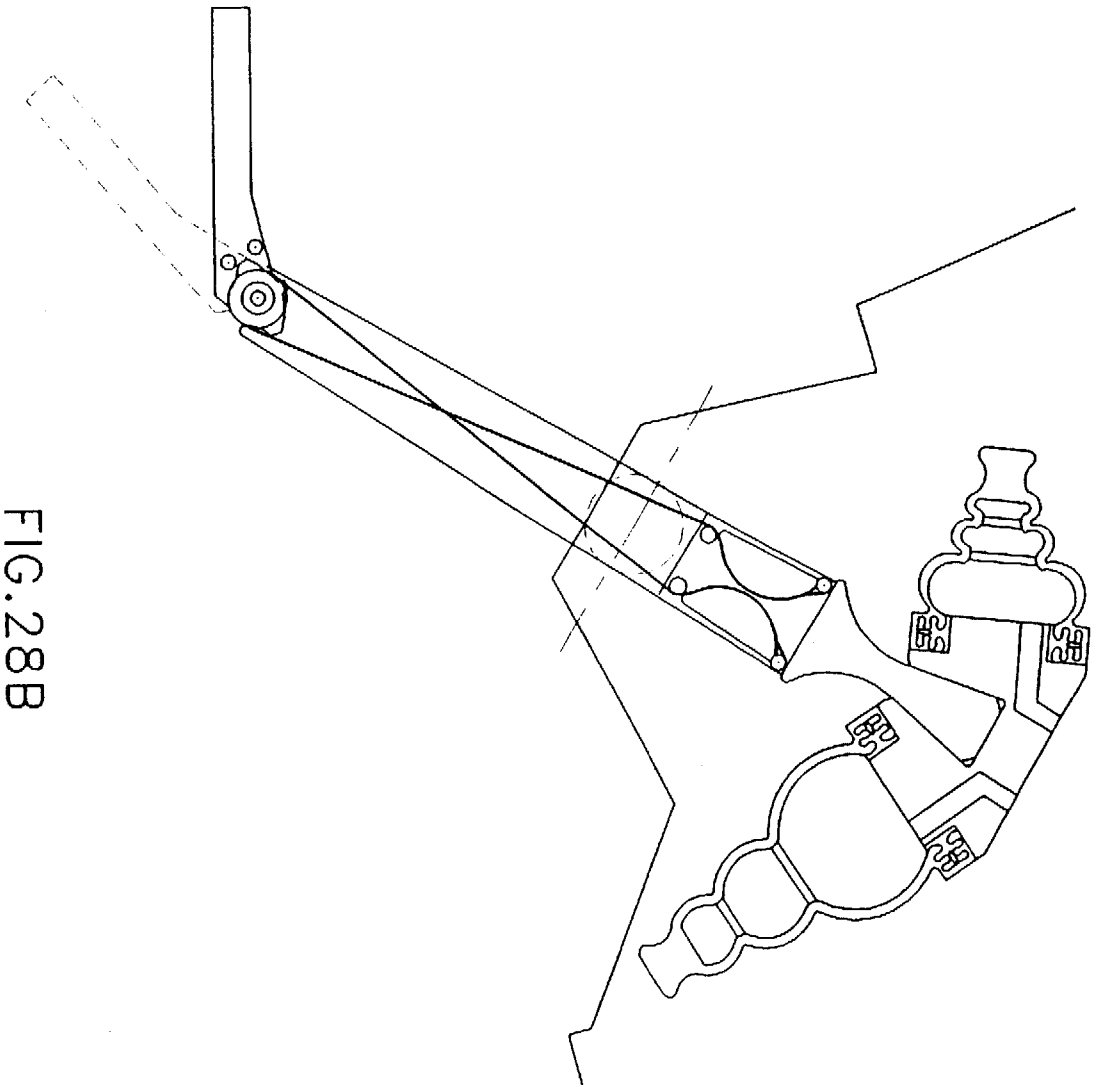
Figure 28C:
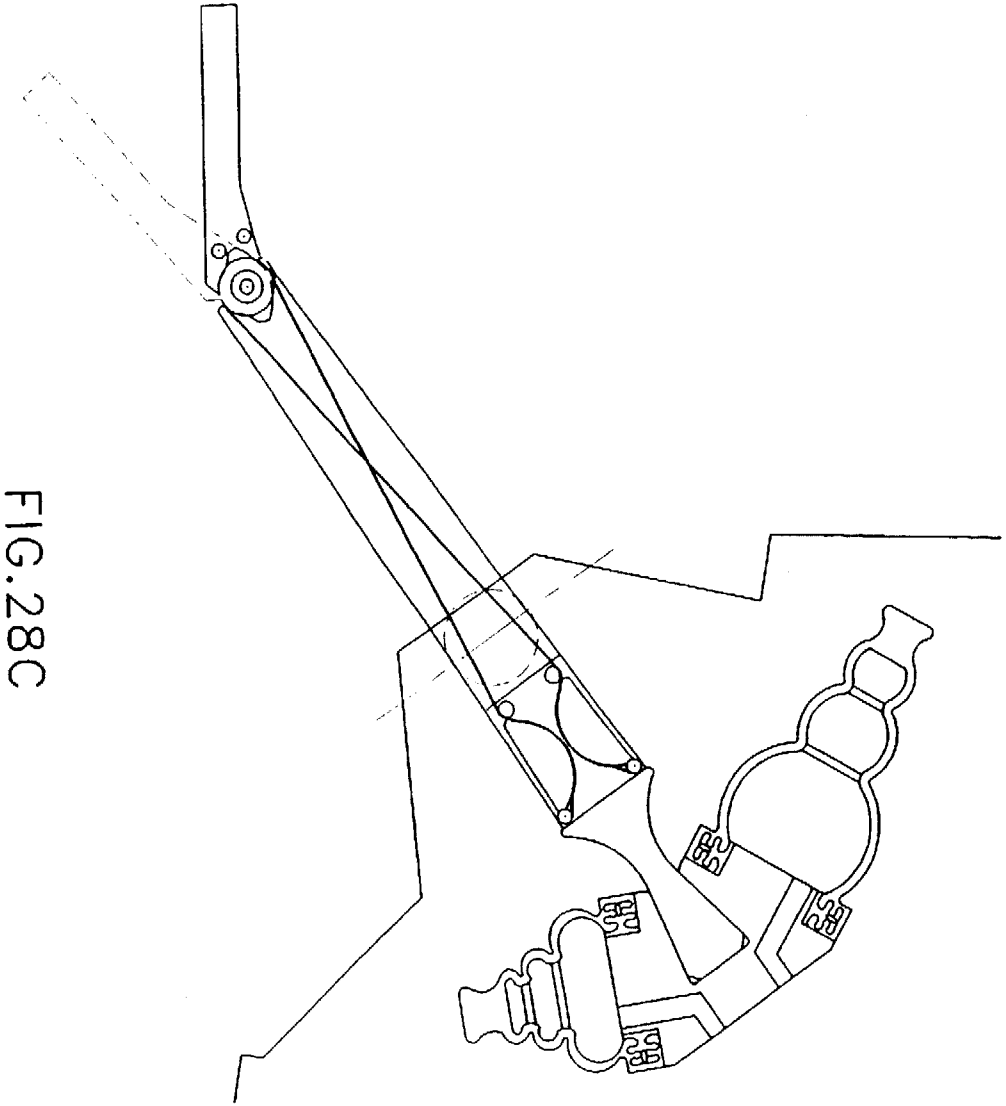

Reference is now made to FIGS. 28A, 28B and 28C, which are simplified illustrations of a shock absorber equipped foil assembly constructed and operative in accordance with another preferred embodiment of the invention in three alternative operative orientations.

A main foil portion 600 is pivotably mounted onto a hull 602 and is provided with a pair of integrally formed multistage shock absorbers 604 and 606 for absorbing shocks in both directions of permitted rotation of the main foil portion.

Figure 29A:
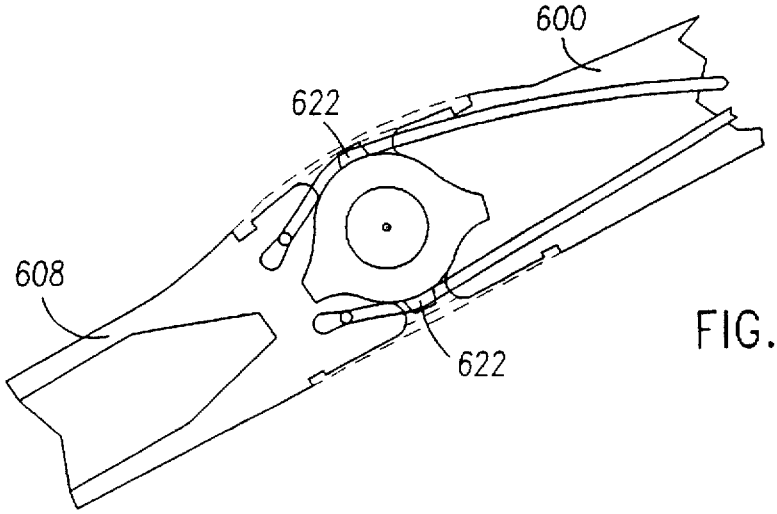
FIGS. 29A and 29B are simplified illustrations of a hinge forming part of the apparatus of FIGS. 28A–28C in two alternative operative orientations.
Figure 29B:
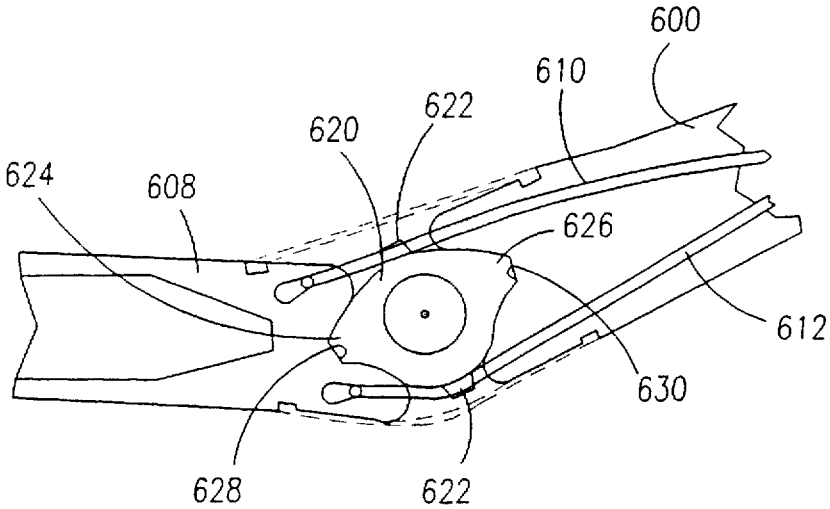

Hingedly mounted onto the main foil portion 600 is a foil tip portion 608, whose position with respect to the main foil portion 600 is determined by the relative positions of a pair of positioning bands 610 and 612 whose extreme ends are coupled to opposite sides of foil tip portion 608, as more clearly shown in FIGS. 29A and 29B.

Figure 32A:
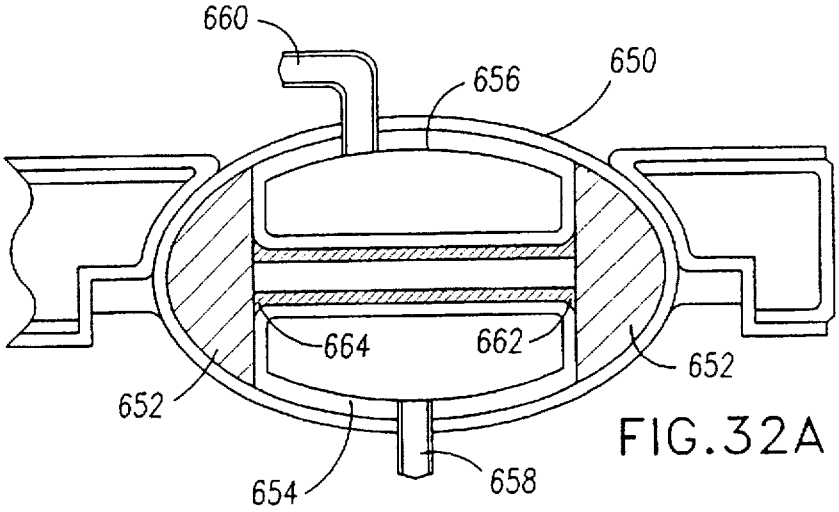
FIGS. 32A, 32B and 32C are illustrations of a pillow actuator useful in the apparatus of FIGS. 28A–28C, in three alternative operative orientations.
Figure 32B:
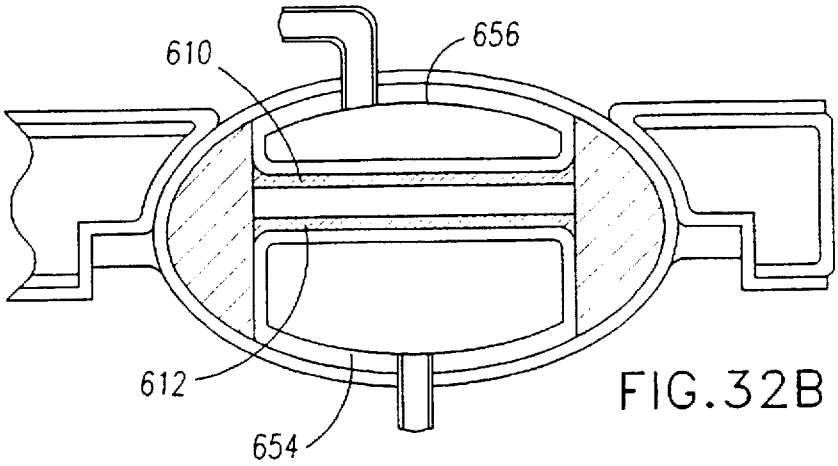
Figure 32C:
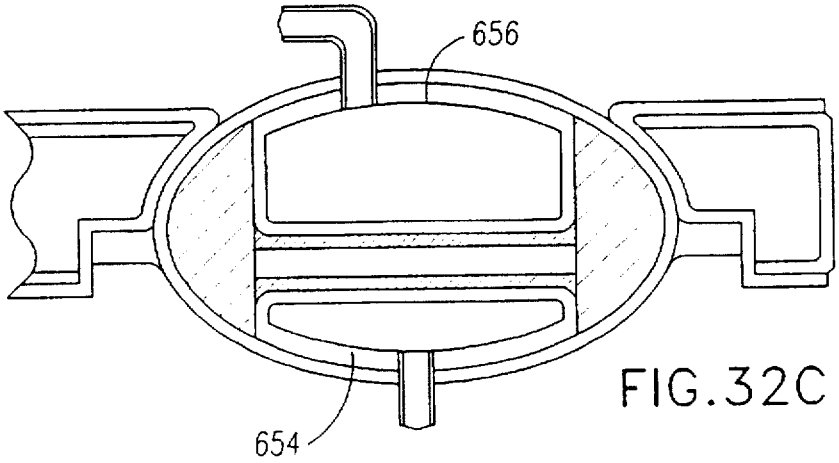

The positions of positioning bands 610 and 612 are respectively determined by a pair of fluid operated pillow assemblies 614 and 616, a preferred embodiment of which is illustrated in FIGS. 32A–32C.

It is noted that in FIG. 28A, the main foil portion is located at an intermediate position with respect to the hull and in FIGS. 28B and 28C, the main foil portion is located at two opposite extreme positions.

Figure 31:
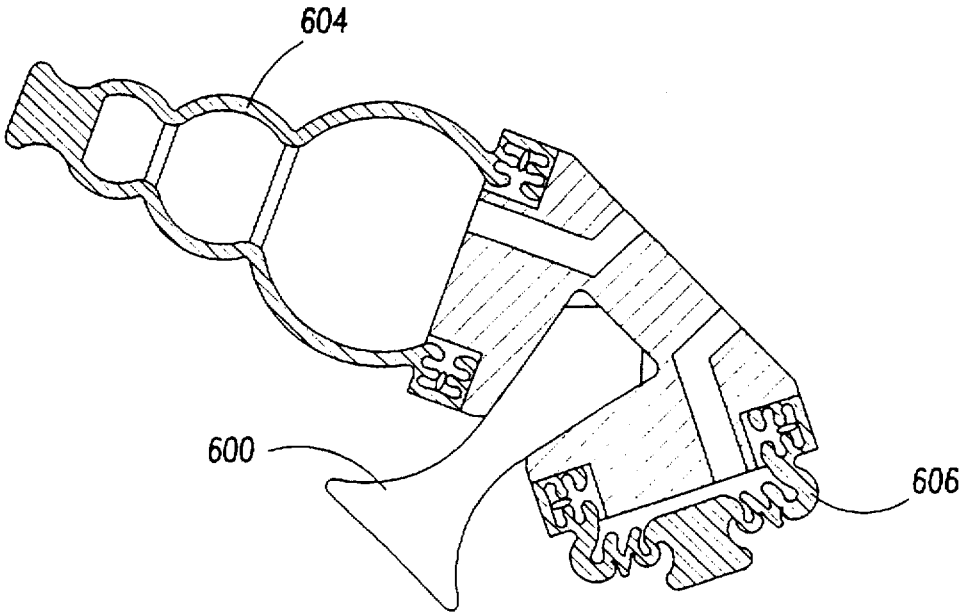
FIG. 31 is a sectional illustration of part of the apparatus of FIGS. 28A–28C.

Reference is now made additionally to FIG. 31, which is a sectional illustration of the shock absorbers 604 and 606 in the orientation of FIG. 28C. It is seen that when a shock absorber, such as shock absorber 606, is fully compressed, each of the multiple chambers thereof at least partially nests in the larger chamber adjacent thereto. It is noted that the various chambers are not volumetrically isolated from each other and are preferably all formed in a single molding process.

Reference is now made to FIGS. 29A and 29B which are simplified illustrations of a hinge forming part of the apparatus of FIGS. 28A–28C in two alternative operative orientations. It is seen that the hinged connection between the main foil portion 600 and the foil tip portion 608 employs a flexible core 620, typically formed of polyurethane. It is seen that the core 620, not only provides relative motion between the main foil portion 600 and the foil tip portion 608 but also defines flexible, shock absorbing bumper portions 622, which limit the pivotal motion of the foil tip portion 608 relative to the main foil portion 600.

The core 620 includes first and second protrusions 624 and 626, which are seated in corresponding recesses 628 and 630 in the foil tip portion 608 and the main foil portion 600 respectively. The flexibility of the core not only permits pivotal motion between the foil tip portion 608 and the main foil portion 600 but also acts as a spring, urging the foil tip portion 608 and the main foil portion 600 into coaxial alignment.

Figure 30A:
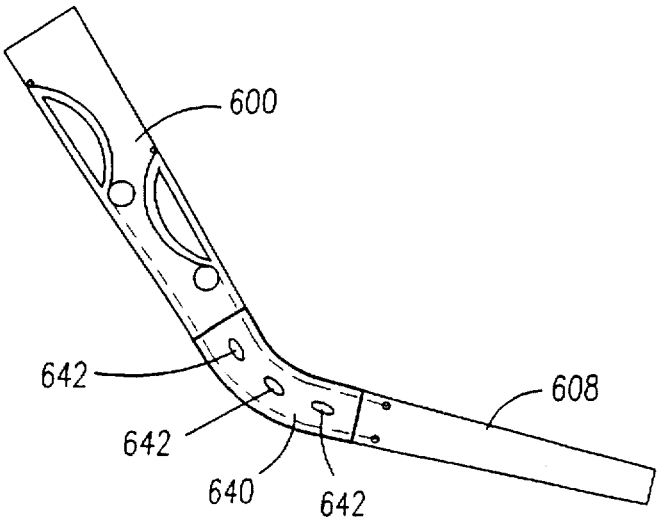
FIGS. 30A and 30B are simplified illustrations of a hinge according to an alternative embodiment of the invention which is useful in the apparatus of FIGS. 28A–28C.
Figure 30B:
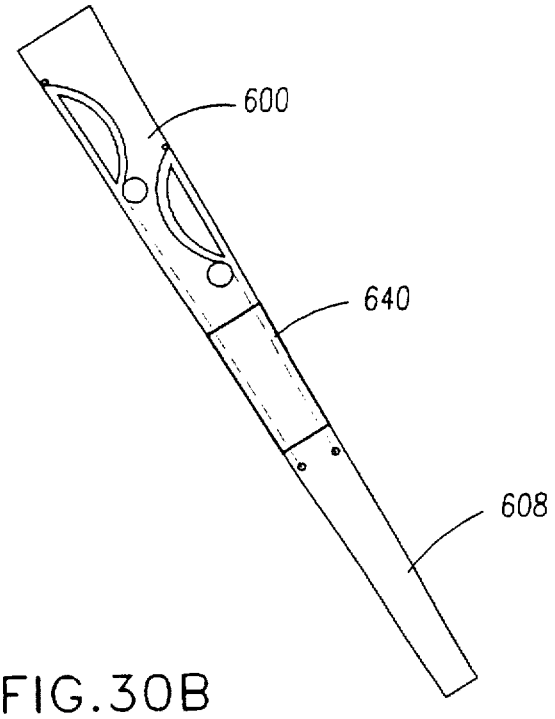

Reference is now made to FIGS. 30A and 30B, which are simplified illustrations of a hinge according to an alternative embodiment of the invention which is useful in the apparatus of FIGS. 28A–28C. Here the main foil portion 600 and the foil tip portion 608 are joined by a flexible elongate intermediate foil portion 640, which is preferably shaped as a streamlined continuation of the foil elements to define a continuous foil assembly. The functionality of the foil portion 640 is similar to that of core 620, except that bumpers are not provided. Rigid elements 642 may be embedded in portion 640 to limit the radius of bending of this portion.

Reference is now made to FIGS. 32A, 32B and 32C which are illustrations of a pillow actuator useful in the apparatus of FIGS. 28A–28C in three alternative operative orientations. The pillow actuator comprises a rigid containment housing 650 typically a cylinder of elliptical cross section. A pair of end portions 652 define a location for two pillows 654 and 656, which receive fluid inputs via respective conduits 658 and 660.

Each of pillows 654 and 656 engages a corresponding positioning band, such as bands 610 and 612. It is noted that the elongate edges 662 and 664 of the bands 610 and 612 are preferably configured with a wedge configuration so as to press the elongate edges 662 and 664 against end portions 652.

FIG. 32A illustrates both pillows in the same orientation, which would normally cause the foil tip portion 608 to assume a partially folded orientation relative to the main foil portion 600. FIG. 32B shows pillow 656 relatively deflated as compared with pillow 654 and FIG. 32C shows pillow 656 relatively inflated as compared with pillow 654. Thus if the operative orientation of FIG. 32B corresponds, for example to the orientation of 29B, the operative orientation of FIG. 32C corresponds to the positioning of the foil tip portion 608 in the opposite direction, as in FIG. 29A.

It will be appreciated by persons skilled in the art that the present invention is not limited by what has been particularly shown and described hereinabove. Rather the scope of the present invention is defined only by the claims which follow:

I claim:

1. Hinge apparatus comprising:

first and second hinge members arranged for relative rotation about a hinge axis; and fluidic actuator apparatus which includes:

a force transfer member having a first end attached to said first hinge member at an anchor location spaced from said hinge axis and being operative in response to application of a force therealong to cause said first hinge member to rotate about said hinge axis relative to said second hinge member; and expandable pillow apparatus associated with said force transfer member and operative to expand when exposed to a fluidic pressure thereby to apply a force along the force transfer member to said first hinge member so as to cause rotation of said first hinge member relative to said second hinge member in at least a first direction.

2. Apparatus according to claim 1, and also including valve apparatus for selectably coupling said expandable pillow apparatus to a fluidic pressure source.

3. Apparatus according to claim 2, and wherein said pillow apparatus has a flexible, expandable contact surface and said force transfer member has a second end attached to said second hinge member such that said force transfer member is positioned against said contact surface, and wherein pressurization of said pillow apparatus causes a lateral displacement of said force transfer member by said contact surface, thereby to cause a force to be applied along said force transfer member to said first hinge member.

4. Apparatus according to claim 3, and wherein said force transfer member is a first force transfer member and said hinge apparatus also includes a second force transfer member which has a first end attached to said first hinge member at an anchor location spaced from said hinge axis, and wherein said pillow apparatus has an additional flexible, expandable contact surface and said second force transfer member has a second end attached to said second hinge member such that said second force transfer member is positioned against said additional contact surface, and wherein pressurization of said pillow apparatus causes a lateral displacement of said second force transfer member by said additional contact surface, thereby to cause a force to be applied along said force transfer member to said first hinge member.

5. Apparatus according to claim 4, and wherein said fluidic actuator apparatus is operable in a first mode to cause rotation of said first hinge member relative to said second hinge member in a first direction, and is further operable, in a second mode, to cause rotation of said first hinge member relative to said second hinge member in a second direction.

6. Apparatus according to claim 5, and wherein said valve apparatus is operative to permit expansion of a single predetermined one of said contact surfaces in accordance with a selected operational mode of said actuator apparatus.

7. Apparatus according to claim 6, and wherein said pillow apparatus comprises a pair of fluid filled pillow members each having one of said contact surfaces.

8. Apparatus according to claim 6 and wherein said valve apparatus is also operative to permit de-pressurization of one of said pillow members thereby to permit contraction of said contact surface thereof when the other of said pillow members is pressurized.

9. Apparatus according to claim 1, and also comprising bumper apparatus mounted in association with said pillow apparatus for absorbing an impact force applied thereto.

10. Apparatus according to claim 1, and wherein said hinge axis is a first hinge axis, said pillow apparatus is first pillow apparatus and said valve apparatus is first valve apparatus, and said hinge apparatus also comprises:

at least a third hinge member associated with a predetermined one of said first and second hinge members and arranged for rotation relative thereto about a second hinge axis;

at least one additional force transfer member having a first end attached to said predetermined one of said first and second hinge members at an anchor location spaced from said second hinge axis;

second expandable pillow apparatus associated with said at least one additional force transfer member and operative to expand when exposed to a fluidic pressure thereby to apply a force to said at least one force transfer member so as to cause rotation of said third hinge member about said second hinge axis in at least a first direction; and second valve apparatus for coupling said second pillow apparatus to a fluidic pressure source so as to operate said second pillow apparatus to cause rotation of said third hinge member.

11. Apparatus according to claim 1, and also comprising:

first and second seating members rigidly attached to adjacent end portions of said first and second hinge members respectively; and a pivot member disposed between said first and second seating members so as to permit relative rotation of said first and second seating members about said pivot member in response to the application of a force along said force transfer member.

12. Apparatus according to claim 11, and wherein said pivot member has a surface configuration which cooperates with at least one of said first and second seating members so as to define a predetermined path of movement for the force transfer member.

13. Apparatus according to claim 11, and wherein said first and second seating members are generally cylindrical and said pivot member defines a generally cylindrical pivot surface for engagement with said first and second seating members.

14. Apparatus according to claim 11, and wherein said pivot member is formed of a flexible, resilient material.

15. Apparatus according to claim 14, and wherein said pivot member is a non-cylindrical flexible, resilient member, adapted to elastically deform in response to application thereto of a force via said force transfer member, thereby to permit relative rotation of the first and second hinge members.

* * * * *